United States Patent [19]

Inaba et al.

[11] Patent Number: 4,702,681

[45] Date of Patent: Oct. 27, 1987

[54] MOTOR DRIVEN SCROLL-TYPE MACHINE WITH COOLING AND LUBRICATING STRUCTURE

[75] Inventors: Tsutomu Inaba; Masahiro Sugihara; Toshiyuki Nakamura; Masahiko Oide; Tadashi Kimura; Norihide Kobayashi, all of Wakayama, Japan

[73] Assignee: Mitsubishi Denki Kabushiki Kaisha, Tokyo, Japan

[21] Appl. No.: 916,078

[22] Filed: Oct. 6, 1986

Related U.S. Application Data

[62] Division of Ser. No. 717,771, Mar. 29, 1985, abandoned.

[30] Foreign Application Priority Data

Mar. 30, 1984 [JP] Japan ..... 59-64585

[51] Int. Cl.[4] ..... F04C 18/04; F04C 29/02

[52] U.S. Cl. ..... 418/55; 418/94; 418/151

[58] Field of Search ..... 418/55, 94, 151; 184/6.16, 6.18

[56] References Cited

U.S. PATENT DOCUMENTS

| | | | |
|---|---|---|---|
| 3,317,123 | 5/1967 | Funke | 418/94 |
| 4,496,293 | 1/1985 | Nakamura et al. | 418/55 |
| 4,596,521 | 6/1986 | Murayama et al. | 418/55 |

FOREIGN PATENT DOCUMENTS

| | | | |
|---|---|---|---|
| 59-18287 | 1/1984 | Japan | 418/94 |

*Primary Examiner*—John J. Vrablik

*Attorney, Agent, or Firm*—Sughrue, Mion, Zinn, Macpeak and Seas

[57] ABSTRACT

A scroll-type compressor including stationary and orbiting scrolls housed in a shell. A first frame, also housed in the shell, receives a portion of the orbiting scroll. The stationary scroll is fixed to the first frame, and a second frame is further mounted in the shell. A balancer chamber is formed between the first and second frames. A main shaft having a balancer is housed in the balancer chamber rotatably. The main shaft includes an enlarged diameter portion on one end of the shaft which is attached to the orbiting scroll and a small diameter portion on the end of the shaft which is attached to the orbiting scroll and extending between the first frame and the second frame for driving the orbiting scroll. A first bearing is disposed between the main shaft in the first frame for supporting the main shaft at a position between the orbiting scroll end of the shaft. A second bearing is disposed between the main shaft and the second frame for supporting the main shaft at a position proximate opposite the end of the shaft. The main shaft has an axial oil passage that extends from a bottom portion that is in contact with an oil pan at the bottom of the shell to an eccentric hole in the top of the shaft that is adapted to receive the orbiting scroll shaft. Upon rotation of the shaft, oil is pumped up to the eccentric hole. An Oldham coupler at the top of the main shaft and motor mounting legs have oil return holes and passages that assure proper lubrication of the compressor.

4 Claims, 64 Drawing Figures

MOTOR DRIVEN SCROLL-TYPE MACHINE WITH COOLING AND LUBRICATING STRUCTURE

This is a division of application Ser. No. 717,771, filed 3/29/85, abandoned.

BACKGROUND OF THE INVENTION

The present invention relates to a scroll-type compressor machine in which a stationary scroll and an orbiting scroll cooperate with each other to compress a volume of fluid.

Before describing the present invention, the principles of a scroll compressor will be described briefly.

Fundamental components of the scroll compressor are shown in FIGS. 1A to 1D, in which reference numeral 1 denotes the stationary scroll, 2 the orbiting scroll, P a compression chamber formed between the stationary scroll 1 and the orbiting scroll 2, and O the center of the stationary scroll 1.

The stationary scroll 1 and the orbiting scroll 2 have wraps which are the same in configuration except for the direction in which the wraps are wound. Each wrap is composed of a combination of involutes and arcs. The compression chamber P is formed between the wraps when they are assembled.

The operation of this compressor will be described. In FIG. 2, the stationary scroll 1 is stationary spatially and the orbiting scroll 2 is combined with the stationary scroll 1 as shown. The orbiting scroll rotates, i.e., orbits, around the center O of the stationary scroll 1 without changing its spatial attitude i.e., without rotating around its own axis, through positions shown in FIGS. 1A through 1D sequentially. With such movement of the orbiting scroll 2, the volume of the compression chamber P is reduced gradually so that air received at an outside position into the compression chamber P is compressed and discharged near the center portion of the stationary scroll 1 at which the degree of compression becomes maximum.

A typical example of the conventional scroll-type compressor will be described with reference to FIG. 2. The scroll compressor shown in FIG. 2 is applied to, for example, a refrigerator, an air conditioner or an air compressor, in which it is adapted to compress a gas such as Freon gas. In this figure, 1 is a stationary scroll, 2 is an orbiting scroll, and 201 is a base plate of the orbiting scroll 2. 204 is an orbiting scroll shaft, P is a compression chamber, 104*a* is a suction portion of the compression chamber, 616 is a ring mounted on the base plate 201 with a small gap between it and a rear surface of the base plate 201, and 8 is an Oldhams coupling in the form of a ring which is adapted to prevent the orbiting scroll 2 from rotating around its axis while permitting its orbital movement. The Oldhams coupling 8 has a pair of oppositely arranged protrusions 802 on each surface, the protrusion pair on one surface being orthogonal to the protrusion pair on the other surface.

601 is a thrust bearing for supporting the rear surface of the base plate 201 of the orbiting scroll. 670 is a bearing support to which the stationary scroll 1 is fixed by bolts, etc., and which is fixed to a shell by pressure fitting etc., the shell being described later. 605 is a chamber defined by the base plate 201, the ring 616 and the bearing support 670 for housing the Oldhams coupling. 604 is an oil return path connecting the chamber 605 and a motor chamber to be described. 11 is a stator of a motor mounted on the bearing support 670, 10 is a rotor of the motor, 4 is a crankshaft, 404 is an oil hole provided eccentrically in the crankshaft 4. 5 is an orbiting scroll bearing provided eccentrically in the crankshaft 4 for supporting the orbiting scroll shaft 204. 602 is a main bearing for supporting an upper portion of the crankshaft 4, 702 is a bearing for supporting an intermediate portion of the crankshaft 4. 402 is a first balancer fixed on an upper portion of the rotor 10. 403 is a second balancer fixed on a lower portion of the rotor 10. 9 is the shell supporting the bearing support 670, the shell 9 being adapted to seal air-tightly the whole of the compressor. 909 is an oil reservoir provided at a bottom of the shell 9. 904 is a suction pipe communicating a motor chamber 912*b* with the atmosphere outside the shell 9. 614*b* is a fluid path formed partially between the bearing support 670 and the shell 9. 905 is a discharge pipe for discharging gas around the center of the scroll 1 to the outside of the shell 9, and 10*e* is an air path passing through the rotor 16*b*.

The operation of the scroll compressor constructed as above will be described.

When power is supplied to the stator 11 of the motor, the rotor 10 thereof produces a torque sufficient to drive the crankshaft 4. When the crankshaft 4 starts to rotate, torque is transmitted to the orbiting scroll shaft 204, supported by the orbiting bearing 5 provided eccentrically on the crankshaft 4, and the orbiting scroll 2 orbits, guided by the Oldhams coupling 8, so that compression is obtained as explained with reference to FIGS. 1A to 1D. Gas introduced through the suction pipe 904 to the motor chamber 912*b* passes through an air gap formed between the stator 11 and, the rotor 10 and the air path 10*e* while cooling them. The direction of gas flow is changed near the oil reservoir 909, afterwards passing through the path 614*b* to the suction chamber 104*a* and then to the compression chamber P. In the compression chamber P, the gas is forced gradually to the center of the stationary scroll 1 upon rotation of the crankshaft 4, and discharged finally through the discharge pipe 905 provided in the center portion.

Describing the oil supply system, a lubrication oil 909*a* from the oil reservoir 909 is forced, by the pumping action of the oil path 404 provided eccentrically in the crankshaft 4, to move from a lower end of the crankshaft 4 through the oil path 404, the orbiting bearing 5 and the main bearing 602 to the motor bearing 702 (as shown by a dotted arrow) and, after passing through the thrust bearing 601, discharged to the Oldhams chamber 605. The oil in the Oldhams chamber 605 drops through the oil return path 604 to the motor chamber 912*b* and, after passing through the air gap between the stator 11 and rotor 10, returns to the oil reservoir 909.

The orbital movement of the orbiting scroll 2 due to the rotation of the crankshaft 4 tends to vibrate the compressor because the latter may have an unbalanced structure. However, since the first and second balancers 402 and 403 act to balance the crankshaft 4 and associated parts thereof, the compressor can operate without abnormal vibration.

Such a conventional scroll-type machine, however, is defective due to the fact that the balancers 402 and 403 are mounted on the rotor 10. The crankshaft is subject to a large bending moment due to centrifugal forces acting on the balancers, resulting in uneven radial forces acting on the main bearing 602 and the motor bearing 702, which degrades the reliability of the apparatus.

Such a conventional scroll-type compression machine is further defective in that the motor is not sufficiently cooled during operation. A further difficulty is that oil used for lubrication may be carried into the compression section of the machine.

SUMMARY OF THE INVENTION

In view of the above, the present intention was made to obtain a cooling and lubricating capability but is structured to prevent lubricating oil from being carried from the drive section into the compression section.

The above object is achieved, according to the present invention, by providing a scroll-type machine comprising: a stationary scroll housed in a shell, an orbiting scroll housed in the shell for controlling, in cooperation of the stationary scroll, a volume of fluid by orbital movement thereof when driven, a first frame housed in the said first frame housing a portion of the orbiting scroll and providing fixed support to the stationary scroll, a second frame supporting the first frame and itself being supported by the shell; attached at one end to said orbiting scroll, the main shaft extending between the first and second frames for driving the orbiting scroll, a first bearing disposed between the main shaft and the first frame for supporting the main shaft proximate the end attached to the orbiting scroll with respect to the balancer, and a second bearing disposed between the main shaft and the second frame for supporting the main shaft at the opposite end. The main shaft has an axial oil passage that extends from a bottom portion, that is in contact with an oil pan at the bottom of the shell, to an eccentric hole in the top of the shaft that is adapted to receive the orbiting scroll shaft. Upon rotation of the shaft, oil is pumped up to the eccentric hole. An Oldham coupler at the top of the main shaft and motor mounting legs have oil return holes and passages that assure proper lubrication of the compressor.

Figure 16A:
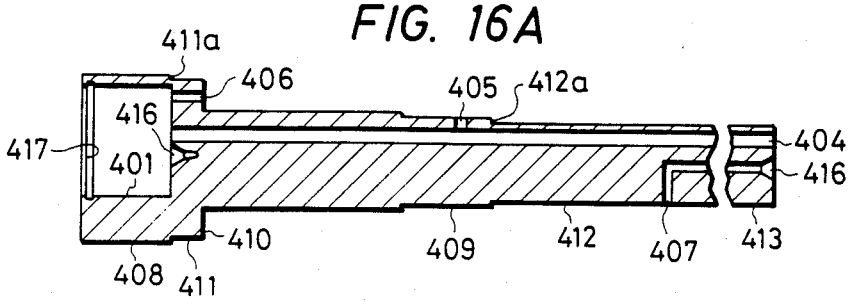
Figure 16B:
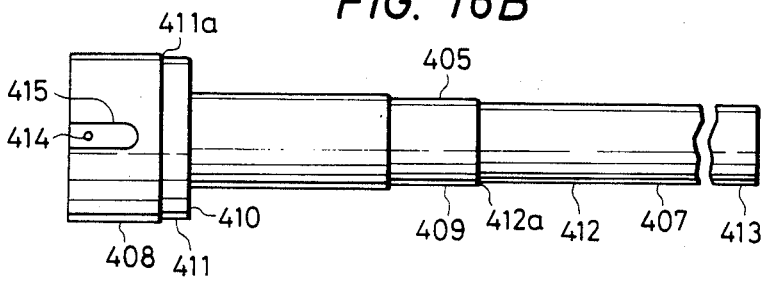
Figure 16C:
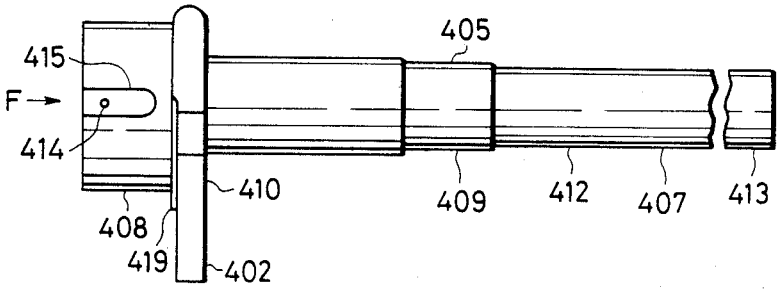
Figure 17:
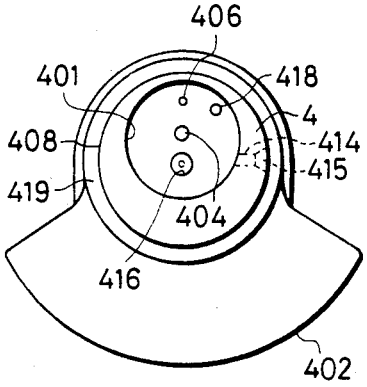
Figure 18A:
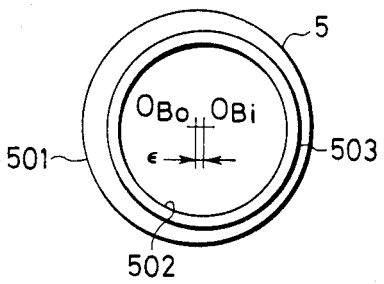
Figure 18B:
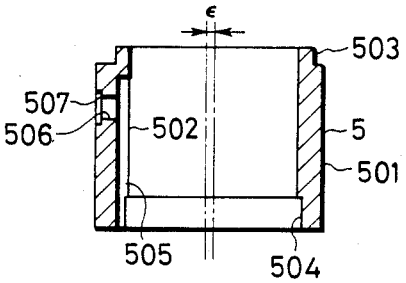
Figure 18C:
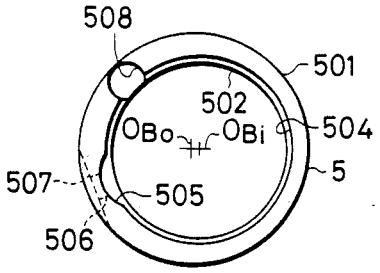
Figure 19:
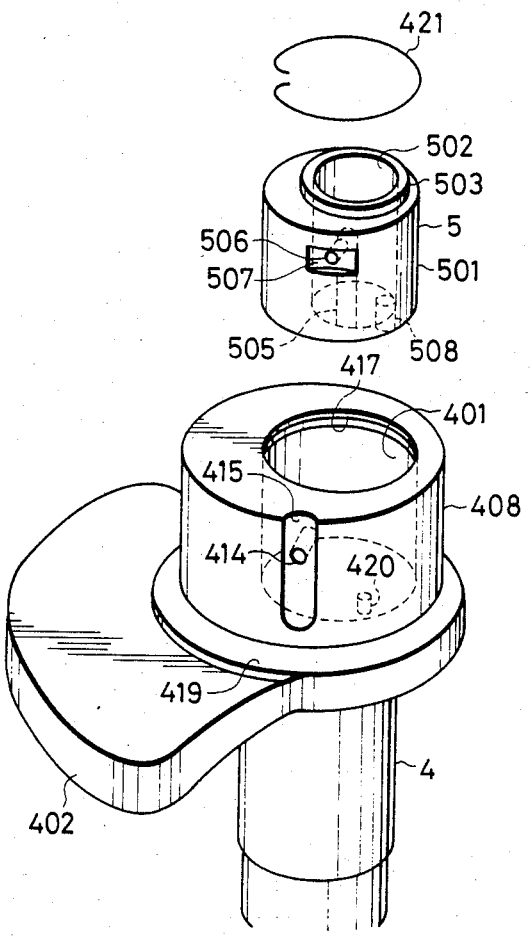
Figure 20:
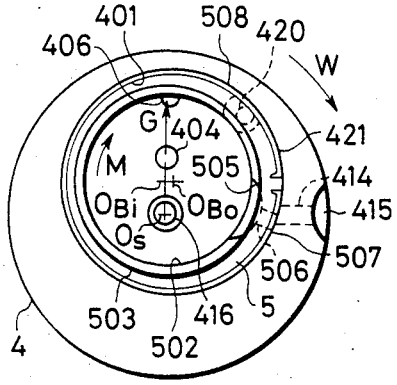
Figure 21:
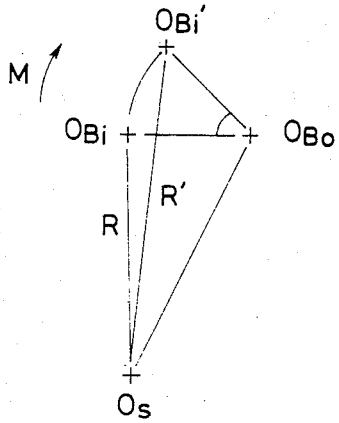
Figure 22A:
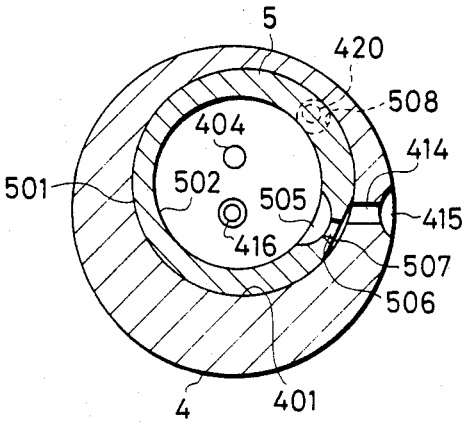
Figure 23:
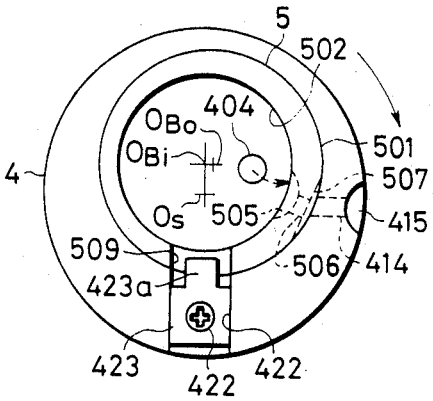
Figure 22B:
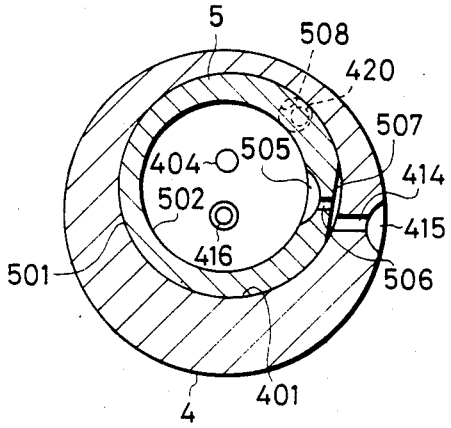
Figure 24:
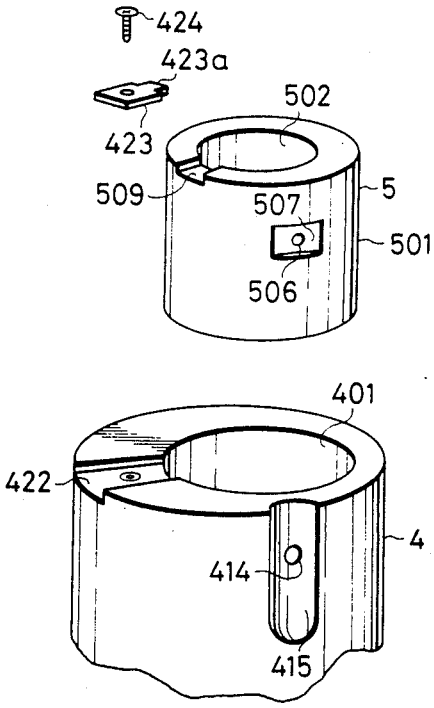
Figure 25:
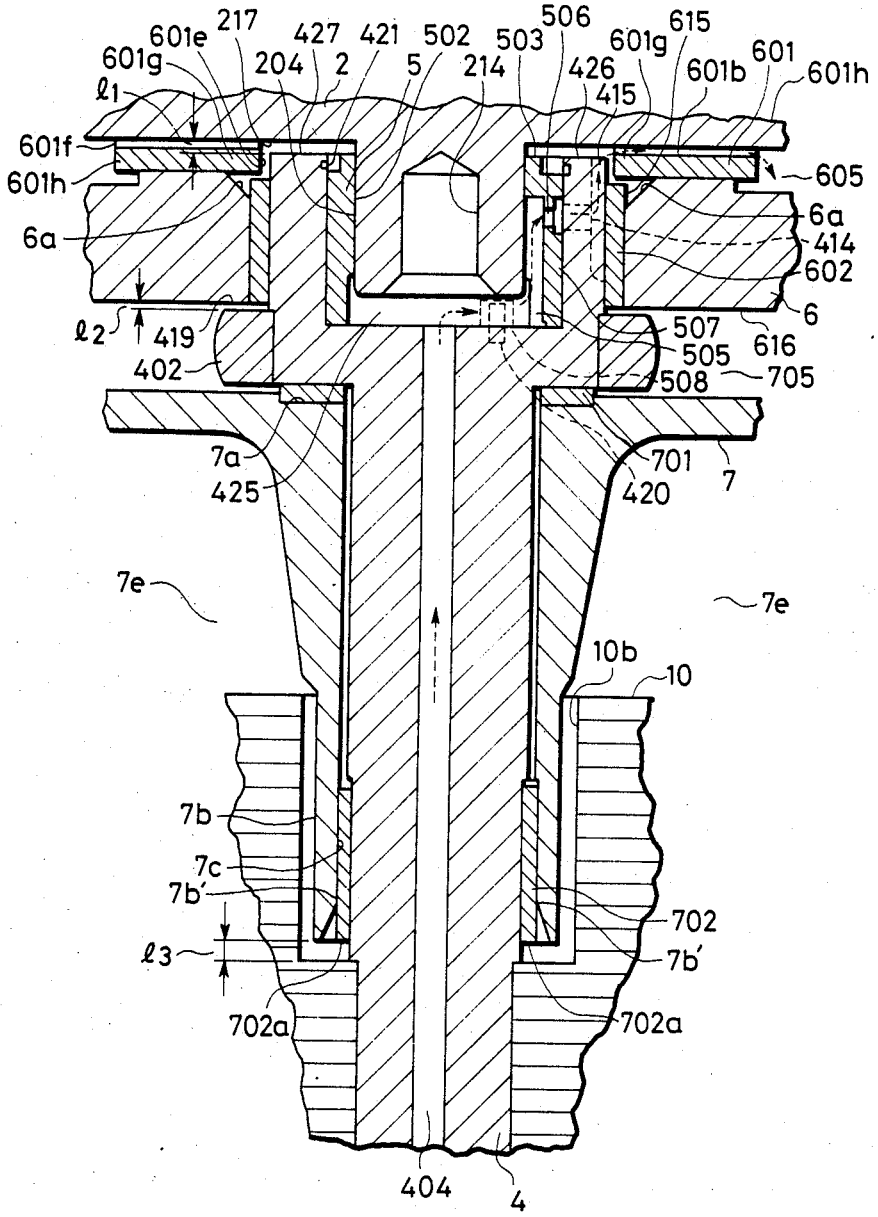
Figure 26A:
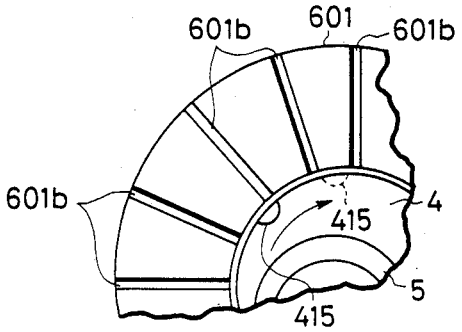
Figure 26B:
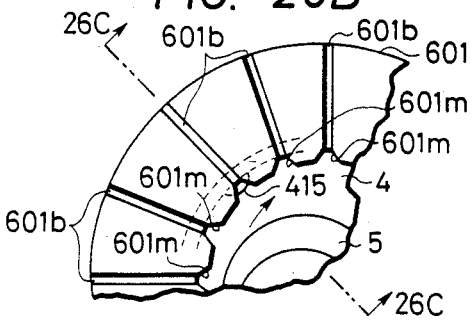
Figure 26C:
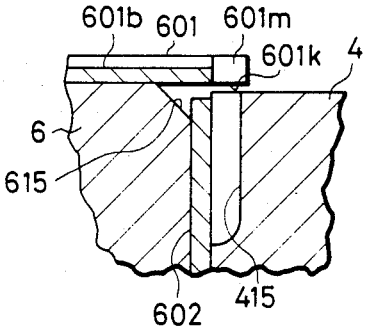
Figure 27A:
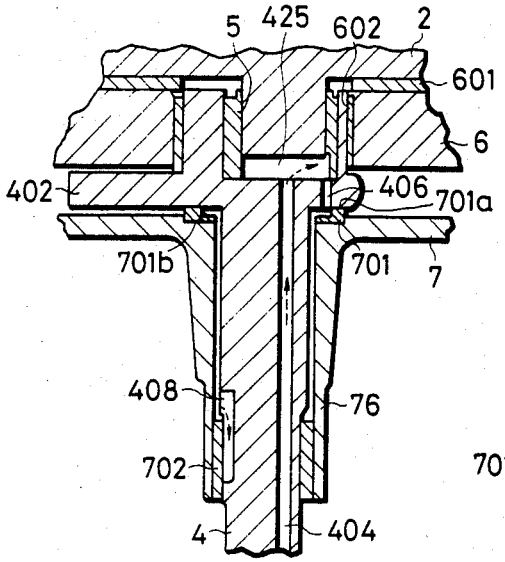
Figure 27B:
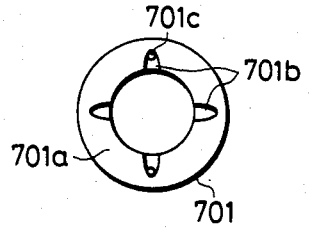
Figure 28:
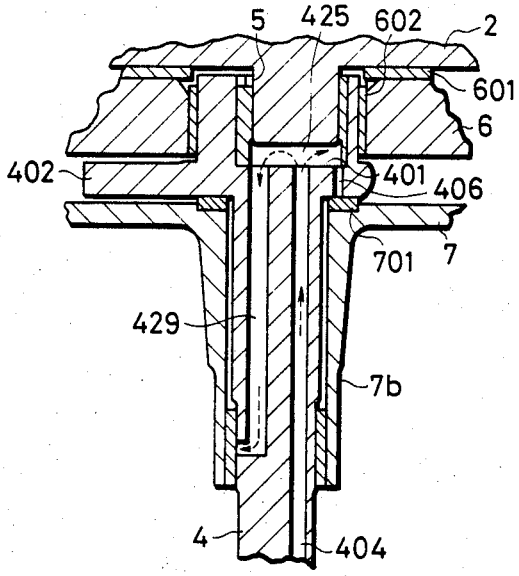
Figure 29A:
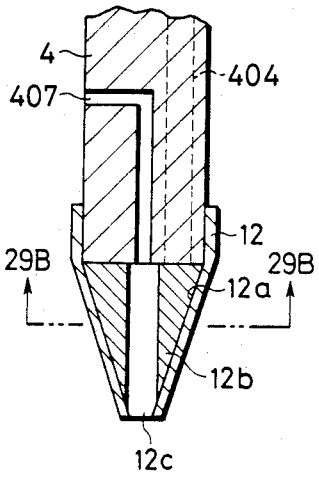
Figure 29B:
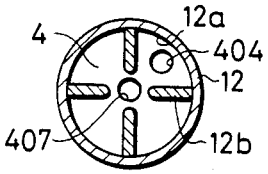
Figure 30A:
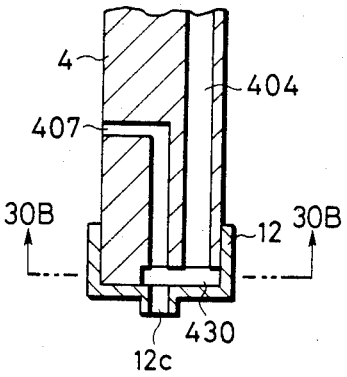
Figure 30B:
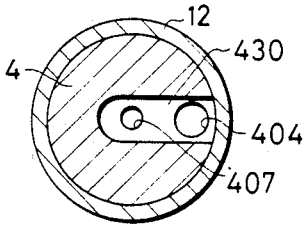
Figure 31A:
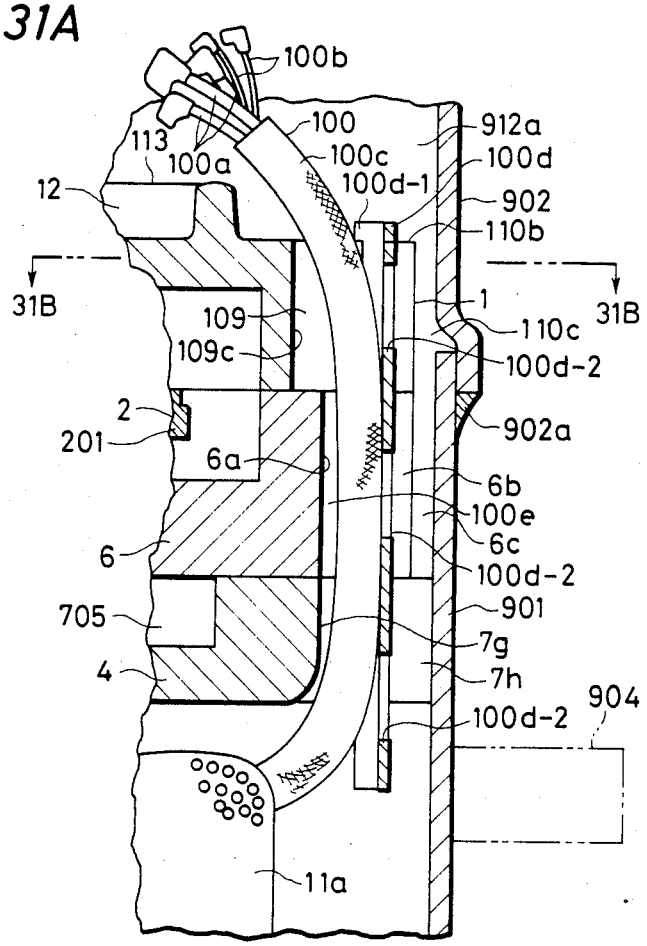
Figure 31B:
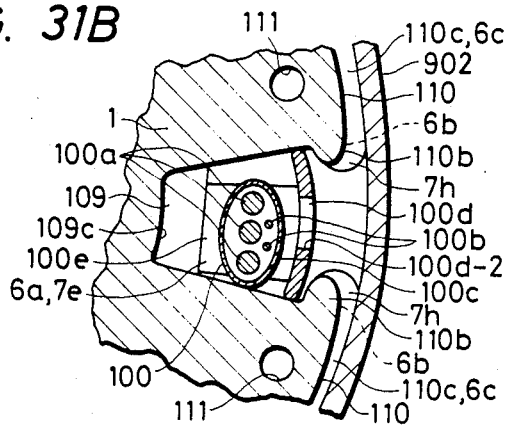
Figure 31C:
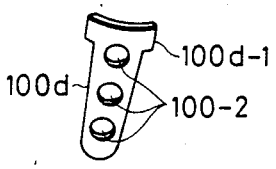
Figure 32:
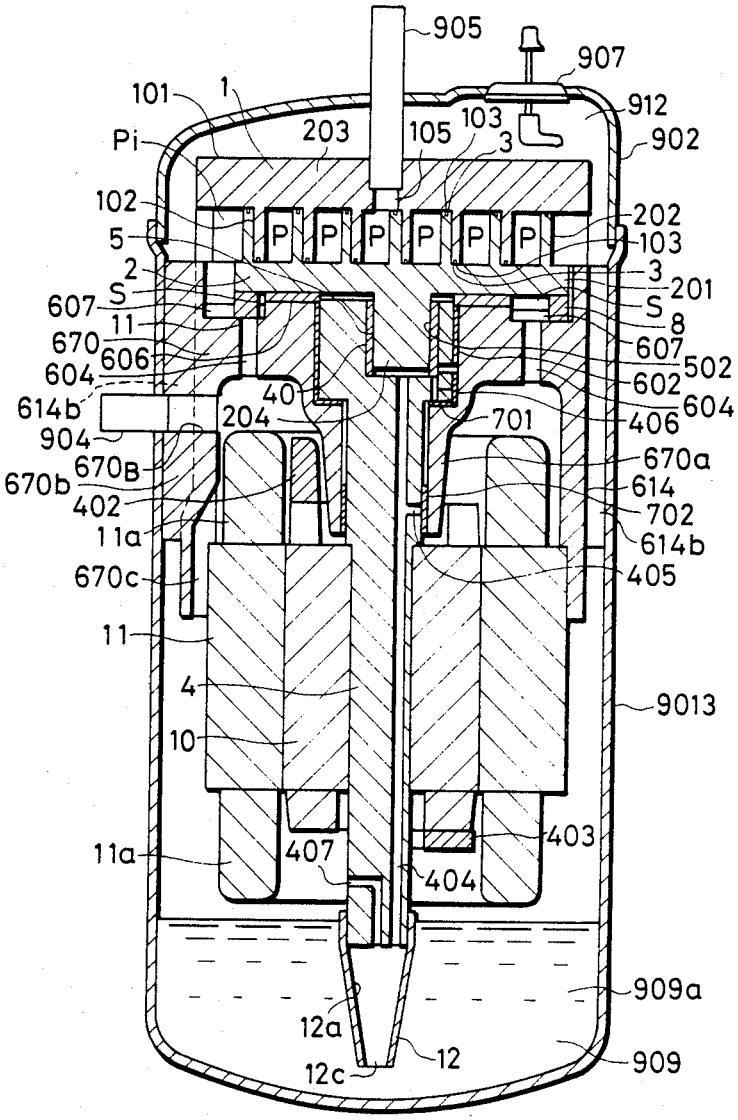
Figure 33:
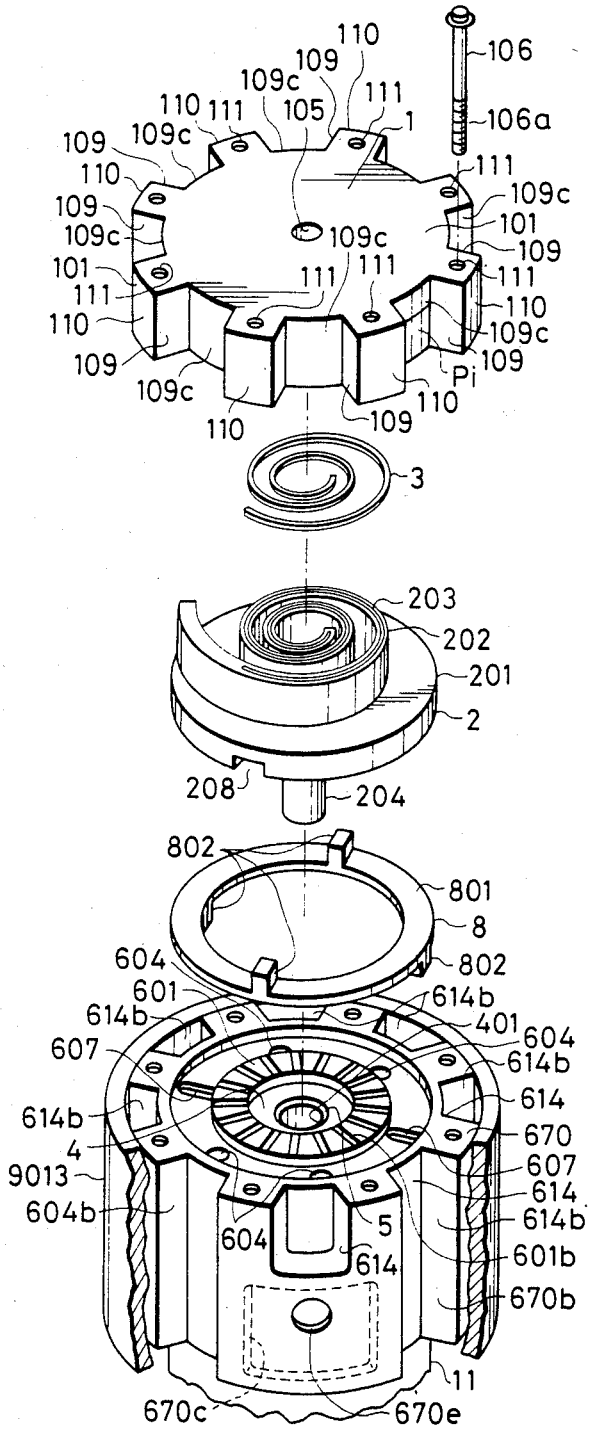
Figure 34:
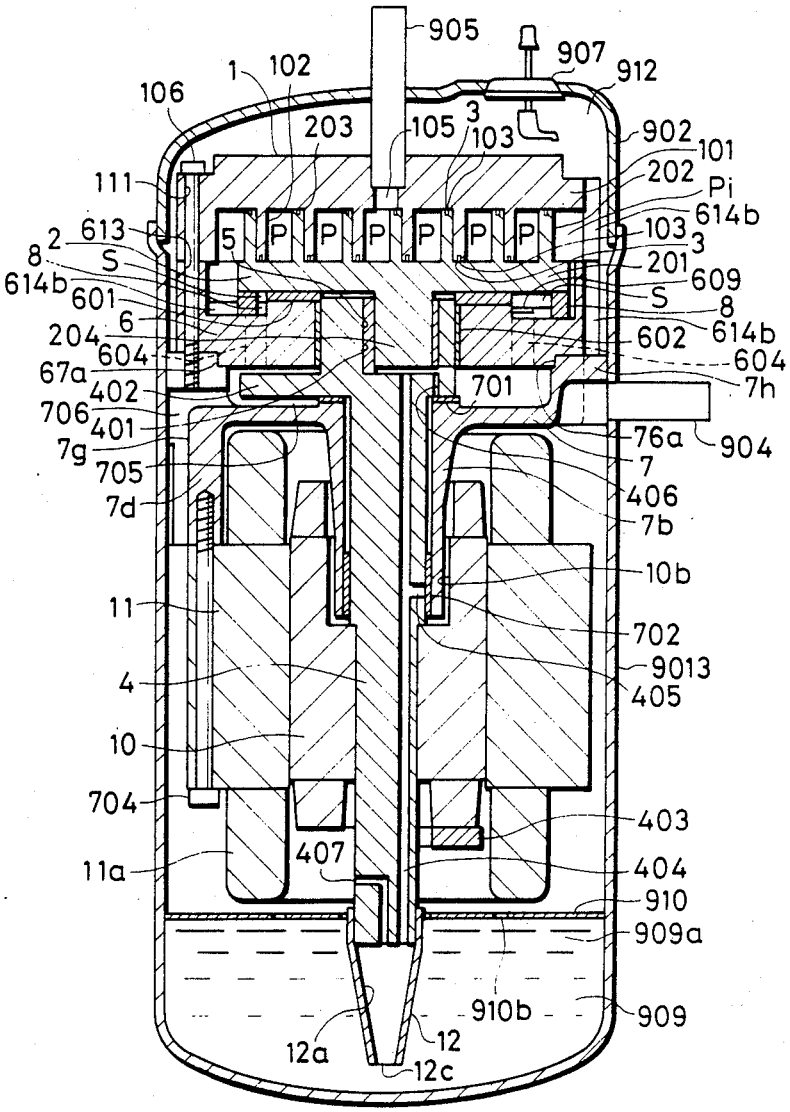
Figure 35:
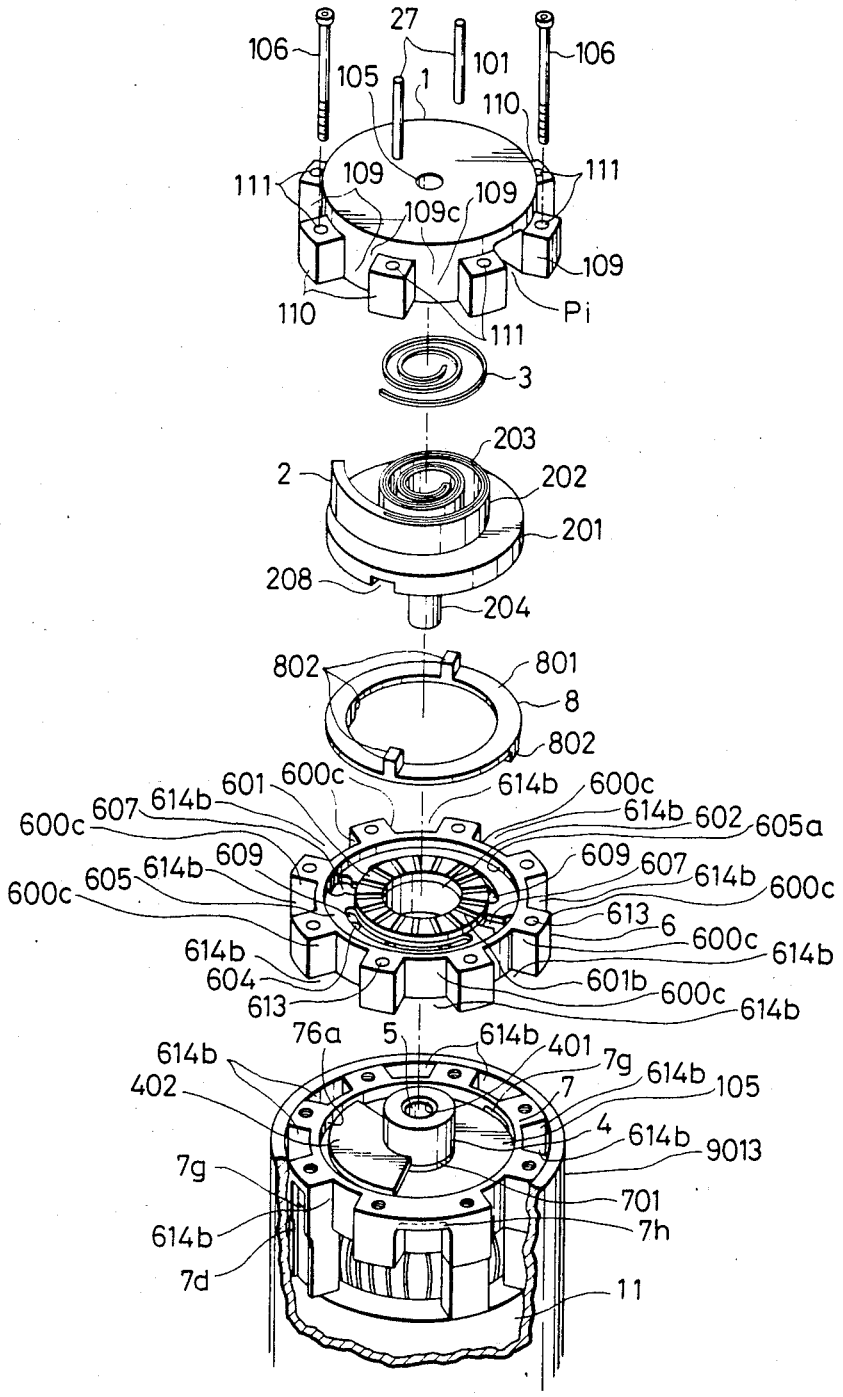
Figure 36:
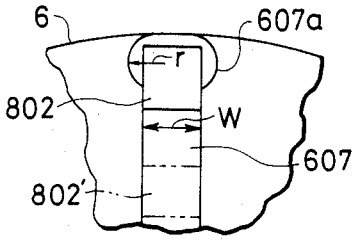
Figure 37A:
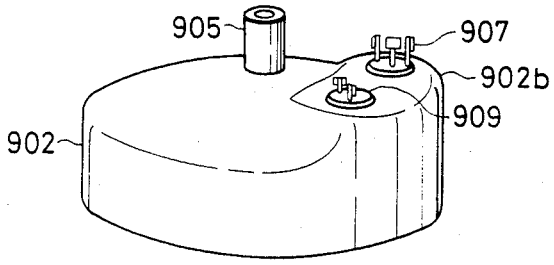

FIGS. **16*a* and 16*b*** are a cross section and a configuration of the main shaft, respectively;

FIG. 16C shows a configuration of the main shaft equipped with balancers;

FIG. 17 is a plan view of the main shaft without an eccentric bushing;

FIGS. 18A, 18B and 18C are, respectively, a plan view, a cross-section and a bottom view of the eccentric bushing;

FIG. 19 is a perspective view of the main shaft and the eccentric bushing when disassembled;

FIG. 20 is a plan view of the main shaft and the eccentric busing when assembled;

FIG. 21 is a view showing an operation of the eccentric bushing;

FIGS. 22A and 22B are cross sections showing the operation of the eccentric bushing;

FIG. 23 is a plan view of an assembled eccentric bushing and the main shaft according to another embodiment of the present invention;

FIG. 24 is a perspective view of the main shaft and the eccentric bushing in FIG. 23 in a disassembled state;

FIG. 25 is an enlarged cross section showing an oil supply system for the main shaft according to another embodiment of the present invention;

FIG. 26A is an enlarged plan view showing a relation of oil grooves of the main shaft and the upper thrust bearing;

FIG. 26B is a similar view showing a relation of es of the main shaft and the upper thrust bearing according to another embodiment of the present invention;

FIG. 26C is a cross section taken along a line 26C—26C in FIG. 26B;

FIG. 27A is a cross section of an oil supply system for a lower main bearing according to another embodiment of the present invention;

FIG. 27B is a plan view of a slide surface of the lower thrust bearing;

FIG. 28 is a cross section showing an oil supply system for the main bearing according to another embodiment of the present invention;

FIG. 29A is a cross section of a centrifugal pump at a lower end of the main shaft according to another embodiment of the present invention;

FIG. 29B is a cross section taken along a line 29B—29B in FIG. 29A;

FIG. 30A is a cross section of the centrifugal pump at the lower end of the main shaft according to another embodiment of the present invention;

FIG. 30B is a cross section taken along a line 30B—30B in FIG. 30A;

FIG. 31A is an enlarged cross section showing a feeding lead wire portion to a motor according to another embodiment of the present invention;

FIG. 31B is a cross section taken along a line 31B—31B in FIG. 31A;

FIG. 31C illustrates a pressure plate used to hold wires;

FIG. 32 is a cross section of a scroll compressor according to another embodiment of the invention;

FIG. 33 is a perspective view of an upper portion of the compressor in FIG. 32 in a disassembled state;

FIG. 34 is a cross section of a compressor according to another embodiment of the present invention;

FIG. 35 is a perspective view of an upper portion of the compressor in FIG. 34 in a disassembled state;

FIG. 36 is an enlarged plan view showing a relation of the Oldhams key and the guide grooves according to another embodiment of the invention;

FIG. 37A is a perspective view of the upper shell in FIG. 32; and

Figure 37B:
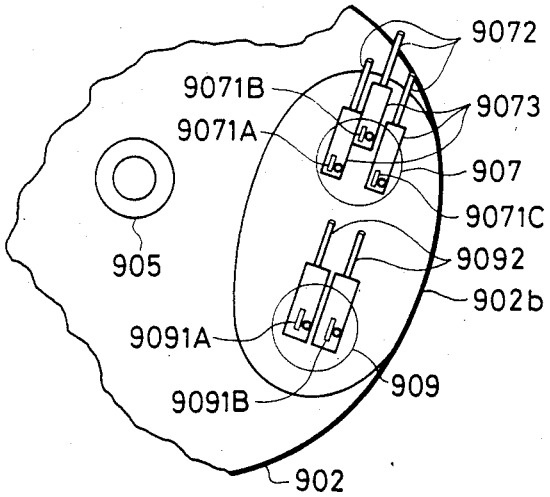

FIG. 37B is an enlarged plan view of the shell in FIG. 37A.

DESCRIPTION OF THE PREFERRED EMBODIMENTS

Figure 3:
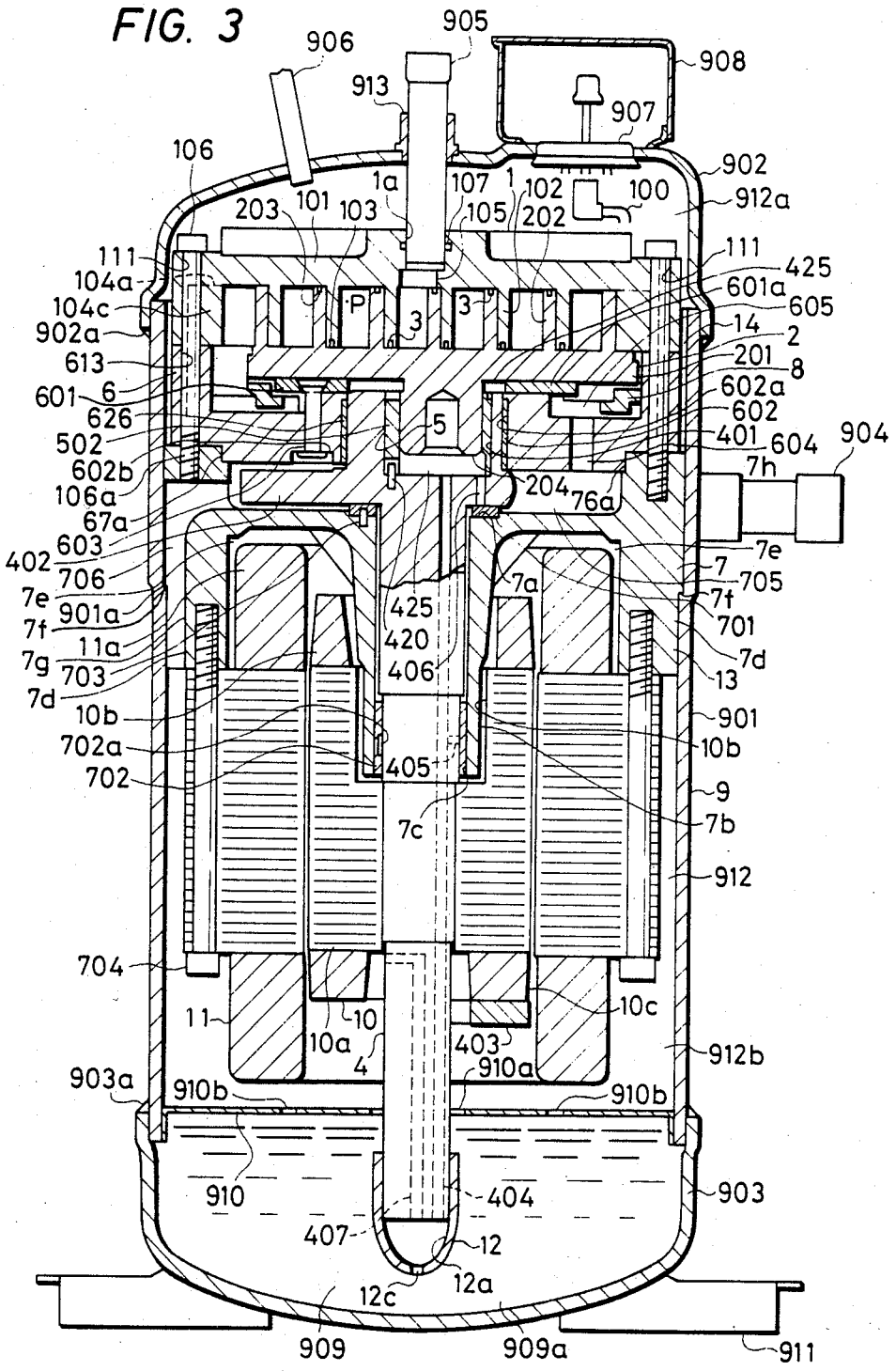
FIG. 3 is a cross section of an embodiment of the inventive scroll-type compressor.

Preferred embodiments of a scroll-type compressor of the present invention will be described with reference to FIGS. 3 to 37. FIG. 3 shows an embodiment of the scroll-type compressor applied to a completely sealed type coolant compressor.

In FIG. 3, 1 is a stationary scroll, 2 is an orbiting scroll, 104*a* is a suction inlet formed in a peripheral wall portion 104*c* of the stationary scroll 1, and 105 is a discharge port formed at a center portion of the stationary scroll 1. The stationary scroll 1 is composed of a based plate 101 in the form of a disc, a side plate 102 formed integrally with the base plate 101 and forming a scroll wrap, and the peripheral wall portion 104*c*. The orbiting scroll 2 is composed similarly of a base plate 201 in the form of a disc and an integrally formed side plate 202 forming a scroll wrap. The scrolls 1 and 2, when assembled, form a compression chamber P defined by the base plates 101 and 201 and the side plates 102 and 202. A plurality of such compression chambers P are formed, and one of them which is located at the center portion of the stationary scroll 1 and the pressure at which is a maximum is is connected to the discharge port 105.

The side plates 102 and 202 are formed, in end faces thereof, with grooves 103 and 203, respectively. The grooves run along the wraps, except at inner end portions thereof. Tip seals 3 are inserted vertically movably into grooves 103 and 203.

Further, 4 is a main shaft, 5 is an eccentric bushing for urging the orbiting scroll 2 such that the side plates 102 and 202 are always in contact with each other even if they are abraded. 6 is an upper frame having substantially the same configuration in plane section as that of the stationary scroll 1 and having the same maximum outer diameter as that of the stationary scroll 1. 7 is a lower frame having substantially the same configuration in plane as that of the stationary scroll 1 and having a maximum outer diameter larger than that of the upper frame 6. 8 is an Oldhams coupling. 601 is an upper thrust bearing in the form of a ring which is adapted to support a pressure in the compression chambers P and the weight of the orbiting scroll itself. 701 is a lower thrust bearing in the form of a ring which is adapted to support the weight of the main shaft 4 and a rotor 10 of a motor and to accomodate a thrust load applied to the main shaft 4. 602 is an upper main bearing having an upper surface supporting a radial load of the main shaft 4. The upper main bearing 602 is made of a bearing metal in this embodiment. 702 is a lower main bearing adapted to support, at an intermediate portion, the radial load of the main bearing 4. The lower main bearing 702 is made of a bearing metal in this embodiment. A shaft 204 is formed integrally with a center portion of a rear surface of the base plate 201 of the orbiting scroll 2. The shaft 204 has an axis orthogonal to the rear surface of the base plate 201, parallel with the main shaft 4. An eccentric hole 401 is formed in an upper end face of the main shaft 4. The axis of the eccentric hole 401 is parallel with an axis (rotation center) of the main shaft. The eccentric bushing 5 is inserted rctatably into the eccentric hole 401. The eccentric bushing 5, which has an eccentric hole 502 which is eccentric with respect to the outer periphery thereof and parallel with the axis of the main shaft 4, rotatably receives the shaft 204. The main shaft 4 is supported by the upper main bearing 602 fixed suitably in a through-hole 602*a* provided in the upper frame 6, the lower thrust bearing 701 inserted into a round hole for bearing mounting formed in an upper surface of the lower frame 7, and a lower main bearing 702 fixed in a center through-hole 7*c* of a cylindrical bearing support 7*b* formed integrally with the lower frame 7 and extending downwardly from a center portion of the lower frame 7. The upper frame 6 and the lower frame 7 are arranged, by means of telescopically fitting portions 67*a* and 76*a* thereof, such that the upper main bearing 602 and the lower main bearing 702 are coaxial to each other. The upper main bearing 602 is coaxial to the upper thrust bearing 601 and a radial bearing face 602*b* of the upper main bearing 602 is orthogonal to a thrust bearing face 601*a* of the upper thrust bearing 601. Therefore, the axis of the main shaft 4 is coaxial to the axis of the upper thrust bearing 601 and is kept orthogonal to the thrust bearing face 601*a*. Further, since the orbiting scroll 2 is supported at the rear face of the base plate 201 by the upper thrust bearing 601, the base plate 201 of the orbiting scroll 2 is kept orthogonal with respect to the main shaft 4. The upper thrust bearing 601 is fixed to the upper frame 6 by a plurality of rivets 603 so that it cannot move vertically, horizontally or radially. The fixing may be done by using a plurality of screws instead of the rivets. Rotation of the lower thrust bearing 701 along the rotating direction of the main shaft 4 is prevented by a pin 703 fixed to a bottom of a round hole 7*a* adapted to fixedly receive the bearing 701. In this embodiment, the respective bearings 601, 602, 701 and 702 are slide bearings and thus are made of bearing metal. However, since the bearing load of the lower main bearing 702 is small compared with those of the bearings 601 and 602, it is possible to omit the bearings 701 and 702 and instead to directly receive the bearing loads with the lower frame 7 if the latter is made of cast iron or cast aluminum which exhibits a metal bearing function.

The Oldhams coupling 8, which functions to prevent the rotation of the orbiting scroll 2 around its axis and to permit only orbital movement thereof around the axis of the main shaft 4, is arranged between the base plate 201 of the orbiting scroll 2 and the upper frame 6.

After the respective construction elements described above are assembled in the mentioned relation to each other, the upper frame 6, the lower frame 7 and the stationary scroll 1 are fixed together by a plurality of bolts 106 which penetrate the peripheral wall 104*c* of the stationary scroll 1 and the upper frame 6 and have threaded top ends 106*a* to be screwed into the lower frame 7. The rotor 10 of the driving motor is fixed on the main shaft 4 by a suitable technique such as pressing-fitting, and the stator 11 of the motor is arranged with respect to the rotor 10 with a suitable air gap therebetween. Then, the stator 11 is fixed to a lower surface of an outer peripheral extension 7*d* extending downwardly of the lower frame 7 by a plurality of bolts 704. The motor for driving the main shaft 4 is supported in place. An upper central portion of a core 10*a* of the rotor 10 is formed with a hole 10*b* for receiving a lower end of the cylindrical bearing support 7*b* with a small gap therebetween. In a space 7*e* formed between the cylindrical bearing support 7*b*, and the peripheral extension 7*d* of the lower frame 7, an upper portion of a stator winding 11*a* and an upper end ring 10*b* of the rotor 10 are received.

Since the orbiting scroll 2 is eccentrically arranged with respect to the axis of the main shaft 4, it is necessary to balance the rotary system. In order to achieve balancing of the rotary system, the first balancer 402 is formed integrally with the main shaft 4, and the second balancer 403 is mounted on the lower end ring 10*c* of the rotor 10. The first balancer 402 may be provided separately from the main shaft 4, and the second balancer 403 may be formed integrally with the lower end ring 10*c*. The lower end portion of the main shaft 4 has an oil cap 12 press-fitted or press-inserted thereinto for supplying lubricating oil by a centrifugal pumping action.

A partition wall 7*b* closes an upper end of one of gas passages 614*b* provided in the outer periphery of the lower frame 7. A construction portion 13 provided by assembling the respective constructive elements in the mentioned relation, i.e., the stationary scroll 1, the orbiting scroll 2, the upper frame 6, the lower frame 7, the main shaft 4, the rotor 10 and the stator 11, etc., is fitted in an intermediate cylinder portion 901 of the shell by press-fitting or welding the peripheral portion of the lower frame 7 with respect to the shell. An upper end and a lower end of the intermediate cylinder portion 901 are closed by an upper closure 902 and a lower closure 903, respectively, as shown. Fitting portions 902*a* and 903*a* are welded to form the sealed container 9. In order to facilitate axial positioning of the constructive portion 13 in the intermediate cylindrical portion 901 of the shell 9, the lower frame 7 is formed, in its outer periphery, with a shoulder 7*f*, and the intermediate cylindrical portion 901 is formed, in its inner periphery, with a corresponding shoulder 901*a* with which the shoulder 7*f*, is in contact. The shoulder 901*a* of the intermediate cylindrical portion 901 of the shell 9 may be formed by pressing enlargement or by cutting by means of a lathe. 904 is a suction pipe for taking a low pressure coolant in an evaporator (not shown) into the sealed container 9 through piping (not shown) arranged outside the container 9, 905 is a discharge pipe for discharging high pressure coolant from the compression chamber P to a condenser (not shown) through discharge piping (not shown) arranged outside the container 9, and 906 is process piping for reducing the pressure in the shell 9 and sealing the oil and the gas in the shell 9. 907 is a sealing terminal, 908 is a terminal box, 909 is a lubricating oil sealing, 910 is an anti-foaming plate, and 911 is a compressor mount composed of four legs fixed equiangularly to an outer bottom face of the bottom cover 903 of the shell 9. The suction pipe 904 is connected, by welding, etc., to the peripheral wall of the intermediate cylinder portion 901, and is opened to a lower pressure space 912 in the shell 9. The discharge pipe 905 penetrates a center portion of the upper cover 902 of the shell 9 sealingly and is connected to the discharge port 105 of the stationary scroll 1. An O-ring 107 is provided in a junction portion between the discharge pipe 905 and the stationary scroll 1 so that the lower pressure space 912 in the shell 9 does not communicate with the interior of the discharge pipe 907 or the discharge port 105. Instead of the O-ring 107, it is possible to press-insert the discharge pipe 905 into a communicating port 1*a* of the stationary scroll 1. In order to prevent the O-ring from being degraded by heat produced during the welding of the discharge pipe 905 to the upper cover 902 of the shell if an O-ring is used, it is recommended that, after the discharge pipe 905 is welded to the upper cover 902, the latter be fitted to the intermediate cylindrical portion 901, while inserting the discharge pipe 905 into the communicating port 1*a*, and welded thereto, or that, after the upper cover 902 having a discharge pipe support 913 extending outwardly therefrom is welded to the intermediate cylindrical portion 901, the discharge pipe 905 be inserted into the support 913 and into the communicating port 1*a* and a junction between the support 913 and the discharge pipe 905 soldered. Alternatively, it is possible to connect the discharge pipe 905 to the communicating port la sealingly without using the O-ring 107 by inserting a discharge pipe made from a soft material such as copper into the communicating port 1*a* and then press-inserting a hard pipe into the discharge pipe 905 to enlarge the latter.

The sealing terminal 907 is welded to the upper cover 902. The terminal 907 and the stator winding 11*a* of the motor stator 11 are electrically connected by a lead wire (not shown) in the low pressure space 912 in the shell 9. The low pressure space 912 is partitioned into an upper space 912*a* and a lower space 912*b* by an assembly of the stationary scroll 1, the upper frame 6 and the lower frame 7, and the spaces 912*a* and 912*b* are communicated with each other through a plurality of axially parallel passages 14 defined by peripheral notches formed equiangularly in the stationary scroll 1, the upper frame 6 and the lower frame 7. The suction port 104*a* of the stationary scroll 1 is also communicated with the upper and lower spaces 912*a* and 912*b* through the same passages 14. In order to minimize the resistance to the coolant flow through the passages 14, the number of the passages 14 should be as large as possible.

The lubricating oil supply system will be described. The oil reservoir 909 is arranged in a lower portion of the lower space 912*b* in the shell 9, and the lower end of the main shaft 4 and the oil cap 12 are immersed in the oil 909*a* in the reservoir 909. The anti-foaming plate 910 in the form of a disc is positioned at a level above the oil reservoir 909 and spot-welded peripherally to an inner wall of the intermediate cylindrical portion 901. The anti-foaming plate 910 functions to prevent foaming caused by abrupt lowering of the pressure in the low pressure space 912 during the starting period of the compressor or by agitation of the lubricant oil 909*a* due to rotation of the main shaft 4. The anti-foaming plate 910 is formed at a center thereof with a hole 910*a* through which the main shaft 4 passes.

An oil passage 404 is provided in the main shaft 4 eccentrically, which penetrates the latter shaft parallel to the axis thereof. A lower end of the passage 404 is opened in the oil cap 12, and an upper end thereof is opened in a bottom of the eccentric hole 401, so that the eccentric hole 401 is communicated with the oil reservoir 909. An intermediate portion of the oil passage 404 is opened to sliding surfaces of the main shaft 4 through a radial oil passage 405 formed in the main shaft 4 to supply the oil to a sliding surface of the lower main bearing 702. In order to make the oil supply to the sliding surface of the bearing 702 reliable, a peripheral groove 702*a* is formed on the sliding surface of the lower main bearing 702 such that the radial passage 405 faces toward the peripheral groove 702*a*. An oil passage 406 is formed in the main shaft 4, which extends parallel with the oil passage 404. One end of the passage 406 is opened in the bottom of the eccentric hole 401 and the other end is opened to a sliding surface of the lower thrust bearing 701 to supply oil thereto. A gas relief hole 407 is provided in the main shaft 4, which extends from a lower center portion of the shaft 4 to the peripheral surface thereof. 604 depicts an oil discharge passage penetrating the upper frame 6 vertically to communicate the Oldhams chamber 605, defined by the upper frame 6 and the orbiting scroll base plate 201 and housing the Oldhams coupling 8, with the balancer chamber 705 defined by the upper frame 6 and the lower frame 7 and housing the first balancer 402.

706 depicts an oil discharge passage defined by vertical grooves 7*g* formed on the outer periphery of the lower frame 7 and the inner peripheral surface of the intermediate cylindrical portion 901 used to communicate the balancer chamber 705 with the lower pressure space 912.

The operation of the scroll compressor constructed as described above will now be discussed.

When electric power is supplied through the sealing terminal 907 to the winding of the motor stator 11, a torque is produced which rotates the rotor 10 and hence the main shaft 4. When the main shaft 4 starts to rotate, the rotation thereof is transmitted through the eccentric bushing 5 fitted in the eccentric hole 401 of the main shaft 4 to the shaft 204 of the orbiting scroll 2. The scroll 2 orbits around the axis of the main shaft, guided by the Oldhams coupling 8, and thus the compression action described with reference to FIGS. 1A to 1D is performed in the compression chamber P. During this operation, the tip seals 3 provided in the top end faces of the wraps 102 and 202 are in pressure contact with the base plates 101 and 201, respectively, preventing radial leakage of high pressure coolant in the compression chambers to other lower pressure compression chambers, and the side surfaces of the wraps 102 and 202 are held in contact with each other by making the eccentricity of the orbiting scroll 2 with respect to the main shaft 4 variable by orbiting the eccentric bushing 5 around the axis 204 of the orbiting scroll 2 using centrifugal force produced by the eccentric rotation of the orbiting scroll 2, thus preventing leakage of higher pressure coolant through possible gaps between the side surfaces of the wraps 102 and 202. As to the coolant gas flow, coolant from the evaporator (not shown) flows through the suction pipe 904 into the low pressure space 912 and cools the rotor 10 and the stator 11, etc. Then it passes through the passages 14 and the suction inlet 104*a* to the compression chamber P where it is compressed. The compressed coolant is discharged through the discharge port 105 and the discharge pipe 905 to the condenser (not shown).

The operation of the oil supply system will be described The oil in the oil reservoir 909 is sucked up, by the pumping action produced by the rotation of the main shaft 4, through the oil cap 12 and the oil passage 404 to the eccentric hole 401 to lubricate the eccentric bushing 5. It is also supplied through the oil passage 405 to the lower main bearing 702 and through the oil passage 406 to the lower thrust bearing 701. Further, the oil supplied to the eccentric bushing 5 is supplied through oil grooves and oil passages (not shown) provided in the eccentric bushing 5 and the main shaft 4 to the upper main bearing 602 and, thereafter, to the upper thrust bearing 601. The oil passed through the upper thrust bearing 601 is discharged to the Oldhams chamber 605. Thereafter, it passes through the oil discharge passage 604 to the oil discharge port 706 and then to the anti-foaming plate 910, and finally is returned to the oil reservoir 909. The gas relief port 407 functions to discharge gas in the oil cap 12 to thereby improve the response of the pump and hence the efficiency of the pump.

Figure 4A:
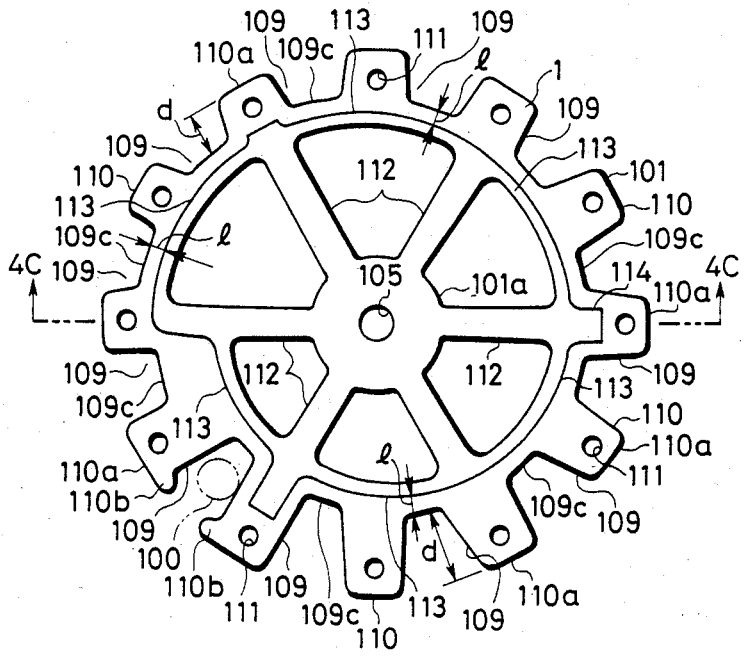
FIG. 4A is a plan view of a stationary scroll of the compressor in FIG. 3.
Figure 4B:
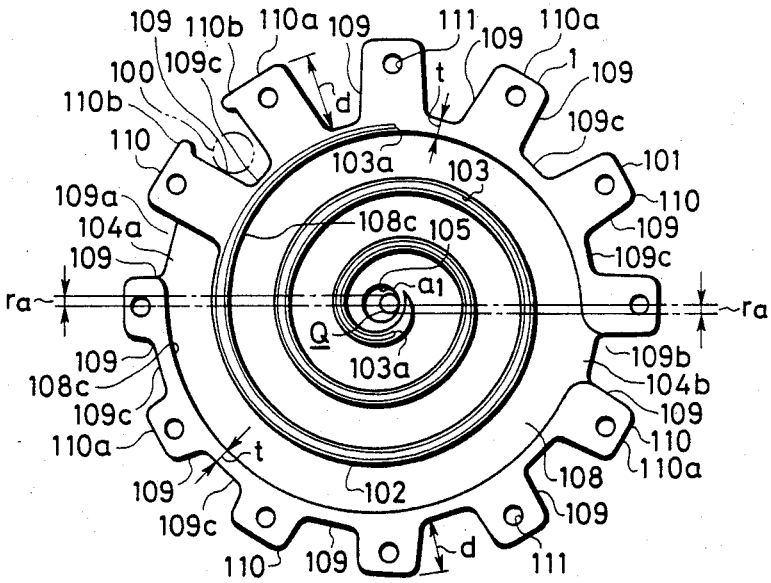
FIG. 4B is a bottom view of the stationary scroll in FIG. 4A.
Figure 4C:
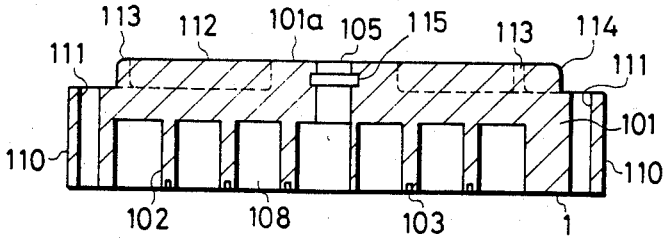
FIG. 4C is a cross section taken along a line 4C—4C in FIG. 4A.

At the starting of the compressor, the pressure in the space 912 in the shell 9 is abruptly reduced, and thus the oil in the oil reservoir 909 foams abruptly, mixing in the coolant gas. Therefore, a large amount of oil is caused to flow through the suction port 104*a* to the compression chamber P. This may be discharged together with gas. However, if this occurs, the oil reservoir 909 will be emptied, resulting in the compressor becoming inoperative. The anti-foaming plate 910 is provided to prevent such a phenomenon. That is, the plate 910 is formed with the oil returning passage 910*b*, the effective size of which is determined such that the oil supplied thereto after passing through the bearing portions and the Oldhams coupling 8 can be returned to the oil reservoir 909 through the passage 910*b* while a larger amount of oil cannot be passed therethrough at one time The structure of the stationary scroll 1 will be described with reference to FIGS. 4A to 4C, in which FIG. 4A is a plan view of the scroll 1, FIG. 4B a bottom view thereof, and FIG. 4C a cross section taken along a line 4C—4C in FIG. 4A. As seen in these figures, a convolute groove 108 is formed in a lower surface of the base plate 101 of the stationary scroll 1, resulting in the wrap 102 being formed integrally with the base plate 101. A center Os of the convolution of the wrap 102 coincides with the center of the base plate 101. The tip seal groove 103 is formed in the end face of the wrap 102, which extends along the convolution of the wrap except opposite end portions of the wraps, and terminates at ends 103*a*.

A plurality of vertically and equiangularly arranged parallel recesses 109 are formed in the outer peripheral surface of the base plate 101, which form coolant gas passages. One (109*a*) of the recesses 109 is communicated with the outermost end of the convolute groove 108, and another (109*b*), which is opposite to the recess 109*a*, is also communicated with the groove 108 The portions of the groove 108 with which the recesses 109*a* and 109*b* are communicated serve as suction inlets 104*a* and 104*b*. The depth d of each recess 109 is made as large as possible, provided that the recesses 109 do not affect the operation of the compressor. The thickness between an outermost side wall 108*c* of the groove 108 and a bottom surface 109*c* of each recess 109 is the same. A bolt hole 111 is formed in each of lands 110, each defined by adjacent recesses 109, through which a bolt (not shown) is screwed to fix the stationary scroll 1 to the lower frame 7. The height d of each land 110 or the depth of each recess is selected such that outer surfaces 110*a*, of the lands 110 are on an imaginary true circle.

A plurality of reinforcement ribs 112 are formed on the upper surface of the base plate 101, which extend radially equiangularly from an outer periphery of a boss 101*a* formed around the center discharge port 105. A convolute reinforcement rib 113 is also formed thereon, which extends around the periphery of the base plate 101 along the outer portion of the groove 108 and integrally connects outer end portions of the radial ribs 112. In other words, the rib 113 is in the form of a closed involute corresponding to the arrangement of the recesses 109. A distance l between the outer periphery of the rib 113 and the bottom surface 109*c* of each recess 109 is the same.

With such reinforcement ribs 112 and 113, it is possible to reduce the relative thickness of the base plate 101 while maintaining the rigidity and strength thereof. 114 depicts the three protrusions adapted to fix the stationary scroll 1 during machining of the side surfaces of the wrap 102 thereof. The protrusions 114 extend radially outwardly from an equiangularly arranged three of the radial ribs 112. 115 depicts a peripheral groove formed in an inner surface of the discharge port 105 in which an O-ring 107 is disposed to seal between the outer periphery of the discharge pipe 905 and the inner periphery of the discharge port 105.

Figure 4D:
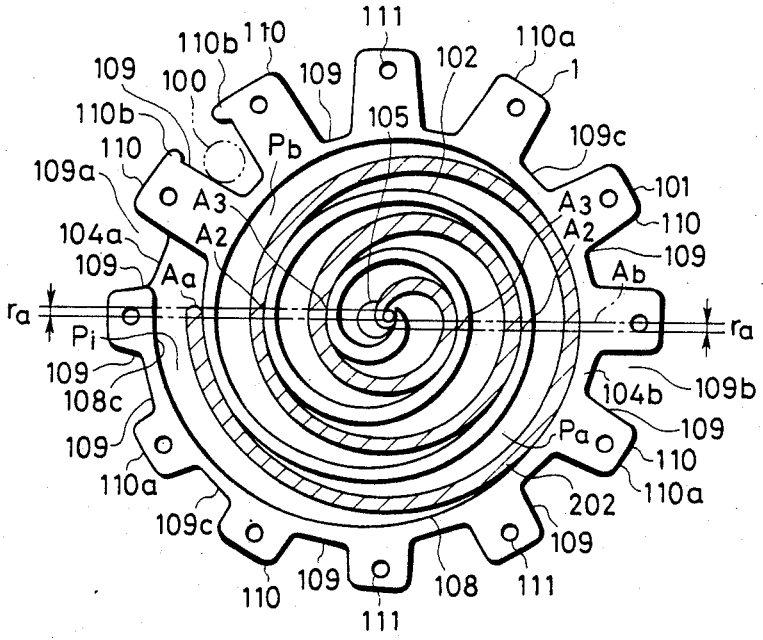
FIG. 4D shows the stationary scroll and an orbiting scroll when assembled.

FIG. 4D shows the stationary scroll 1 and the orbiting scroll 2 in an assembled state. As is clear from FIG. 4D, the suction ports 104*a* and 104*b* are opened to the recesses at positions corresponding to outermost peripheral ends $A_a$ and $A_b$ at which the wrap 102 of the stationary scroll 1 and the wrap 202 of the orbiting scroll 2, respectively, are in contact with each other Since, therefore, a pair of symmetrical pressure chambers Pa and Pb complete their suction of air simultaneously, it is possible to eliminate the mechanical unbalance during the compression period. $A_2$ and $A_3$ depict other contact points of the wraps 102 and 202.

Figure 5A:
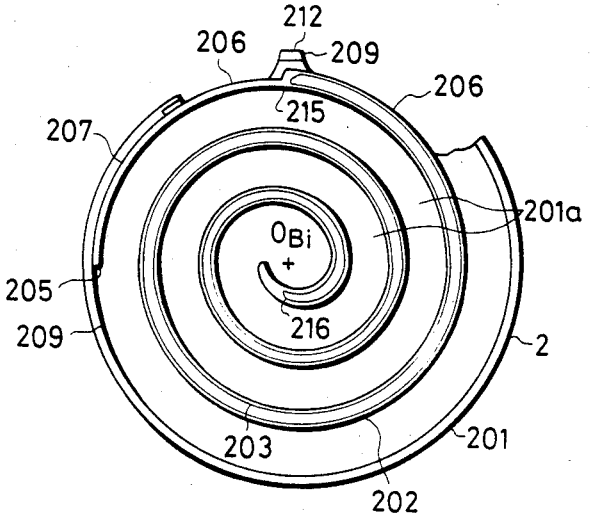
FIG. 5A is a plan view of the orbiting scroll in FIG. 4D.
Figure 5B:
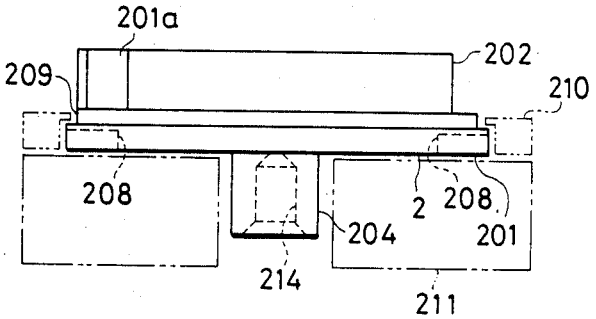
FIG. 5B is a side view of the orbiting scroll in 5A.
Figure 5C:
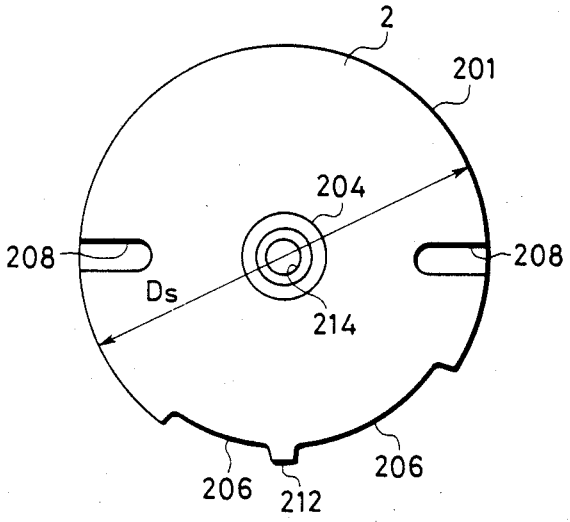
FIG. 5C is a bottom view of the orbiting scroll in FIG. 5A.

The structure of the orbiting scroll 2 will be described with reference to FIGS. 5A to 5C, of which FIG. 5A is a plan view of the scroll 2, FIG. 5B a side view thereof and FIG. 5C a bottom view thereof. In these figures, the wrap 202 is formed on the base plate 201 of the orbiting scroll 2 by forming a convolute groove 201*a* thereon, and the orbiting shaft 204 is also formed integrally on the opposite surface of the base plate 201. The center $O_{Bi}$ of the wrap 202 coincides with the center of the base plate 201 and with the axis of the orbiting shaft 204. The base plate 201 is in the form of a disc whose diameter is determined such that an outer surface of an outermost peripheral end 205 of the wrap 202 is substantially in contact with the outer periphery of the base plate 201.

If the center of gravity of the wrap 202 differs from the centers of the base plate 201 and the orbiting shaft 204, a static unbalance occurs. In order to coincide the gravity center of the orbiting scroll 2 as a whole with the axis $O_{Bi}$ of the orbiting shaft 204 to thereby eliminate the static unbalance, a recess 206 is formed in a portion of the outer periphery of the base plate 201, and the thickness of a portion 207 of the outermost portion of the wrap 202, which does not contribute compression, is reduced compared with other portions thereof. The reduction of the thickness may be unnecessary if the unbalance is removed by only the provision of the recess 206.

208 depicts guide grooves for the Oldhams coupling 8. The guide grooves 208 are arranged oppositely in a lower surface of a peripheral portion of the base plate 201 where there is no recesses.

Figure 6:
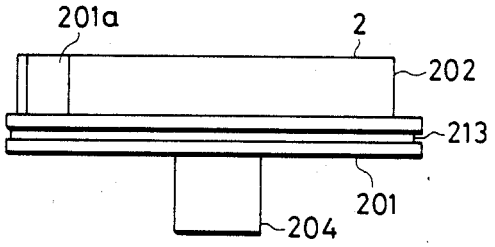
FIG. 6 is a side view of an orbiting scroll according to another embodiment of the present invention.

209 depicts a shoulder formed in the upper periphery of the base plate 201 which is adapted to fixedly secure, together with a pressing ring 210, the orbiting scroll 2 to a flat mounting jig 211 during milling of the wrap 202. With the use of the shoulder 209 together with the pressing ring 210, it is possible to machine the wrap with high precision, without substantial deformation of the base plate 201, which is a problem when the orbiting scroll 2 is held by other than chucking. Since it is desirable to hold the periphery of the base plate 201 uniformly, the recess 206 is divided into two recess portions so that a land 212 is left between them. It is also possible to form an annular groove 213 in the periphery of the base plate 201, instead of the shoulder 209, as shown in FIG. 6, and to insert a plurality of pressing rings similar to the ring 210 in FIG. 5B into the groove.

214 depicts a hollow portion formed in the orbiting shaft 204. With the hollow portion 214, the orbiting shaft 204 is made cylindrical and the weight of the orbiting scroll 2 reduced. Therefore, the weight of the portion which is to be balanced, and hence the centrifugal force produced thereby, are reduced.

203 depicts a tip seal groove formed on and along the wrap 202 whose one end is positioned at a point 215 inside the portion 207 of the wrap 202 whose thickness is reduced for balancing purposes. The other end is positioned at a point 216 which does not adversely affect the discharge port 105 provided in the stationary scroll side, as shown in FIG. 5A. The tip seal groove 103 of the stationary scroll 1 corresponds in configuration to the groove 203 of the orbiting scroll 2.

Figure 7:
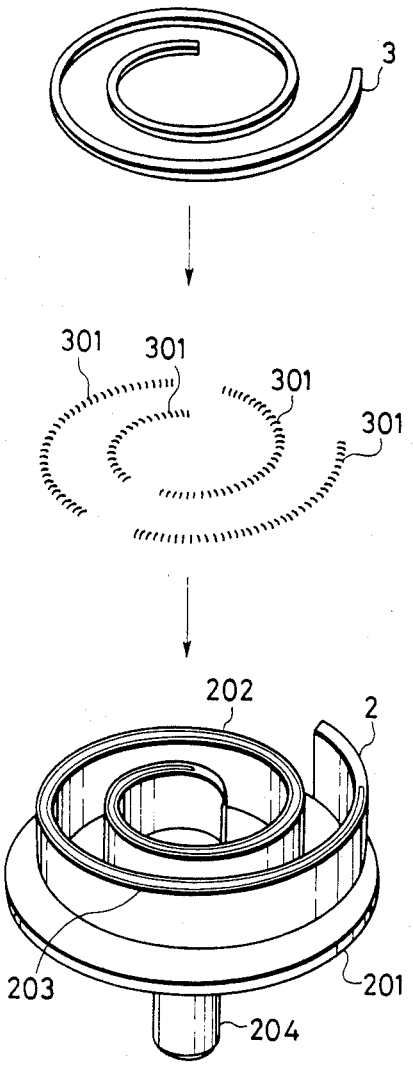
FIG. 7 is a perspective view of the orbiting scroll according to another embodiment of the present invention in a disassembled state.

FIG. 7 is a perspective view showing the assembly of the tip seal 3 in the orbiting scroll 2. 301 depicts a plurality of coil springs for urging the tip seal 3 axially. The coil springs 301 are disposed between a rear surface of the tip seal 3 and the bottom surface of the tip seal groove 203. The arrangement of the tip seal for the stationary scroll is performed similarly.

Figure 8A:
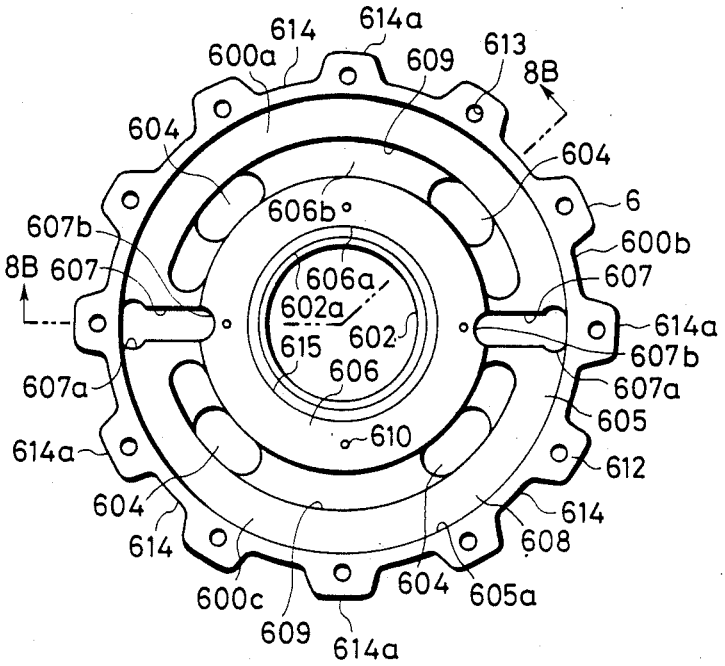
FIG. 8A is a plan view of an upper frame.
Figure 8B:
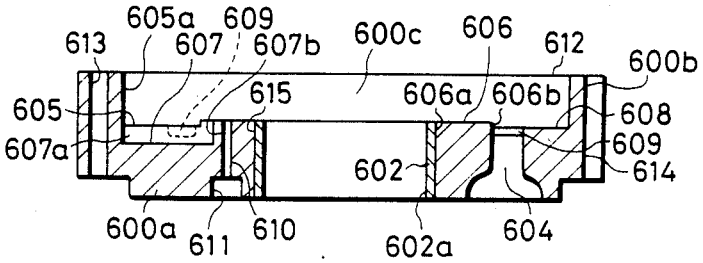
FIG. 8B is a cross section taken along a line 8B—8B in FIG. 8A.

FIG. 8*a* is a plan view of the upper frame 6 and FIG. 8B is a cross section taken along a line 8B—8B in FIG. 8A. In these figures, 600*a* depicts a bottom portion, 600*b* a peripheral wall portion, 600*c*, a recess, 602 the upper main bearing, and 606 a mounting seat formed on an upper surface of the bottom portion 600*a*, for mounting the upper thrust bearing 601 shown in FIG. 3. 607 depicts Oldhams guide grooves, 608 a sliding face of the Oldhams ring, 604 oil discharge holes, 609 relief grooves, 610 rivet holes, 611 an end milled portion, 612 a fixing surface of the stationary scroll, 613 bolt holes, and 614 recesses.

The recesses 614, corresponding to the recesses 109 of the stationary scroll 1, are formed in the periphery of the upper frame 6, and the bolt holes 613 formed in land portions 614*a*, each between adjacent recesses 614, are positioned correspondingly to the bolt holes 111 of the stationary scroll 1.

In more detail, the fixing surface of the stationary scroll 612, the mounting seat 606 and the Oldhams ring sliding face 608 are formed on the upper end face of the wall portion 600*b*, on a surface lower than the fixing surface 612 and on a surface between the wall portion 600*b* and the mounting seat 606 and lower than the latter coaxially. The Oldhams chamber 605 for housing the Oldhams coupling 8 is formed in the vicinity of the Oldhams ring sliding face 608.

In the inner peripheral surface of the mounting seat 606, i.e., in a through-hole 602, the upper main bearing 602 is press-inserted. An inner edge portion of the mounting seat 606 is rounded, as shown at 615, and thus the upper main bearing 602 overhangs the rounded portion 615. The rounded portion 615 is referred to as an inner peripheral face 606*a* of the mounting seat 606, and an outer peripheral surface thereof shown by 606*b*.

The Oldhams guide grooves 607, arranged oppositely on the Oldhams ring sliding face 608, have semicircular relief portions 607*a* formed at outer end thereof, respectively. The relief portions 607*b*, formed at inner end thereof, extend partially to the outer portion of the mounting seat 606. A plurality (in this case, four) of the oil discharge ports 604 are formed in the mounting seat 606, first ends of which are opened to the Oldhams ring sliding face 608 and the other ends of which are opened to the balancer chamber 705. Two of the oil discharge ports 604 are communicated with each other through an arched relief groove 609, and the other pair is communicated with each other by a similar groove 609, the relief grooves 609 being formed on the Oldhams ring sliding face 608 of the upper frame 6.

Figure 9A:
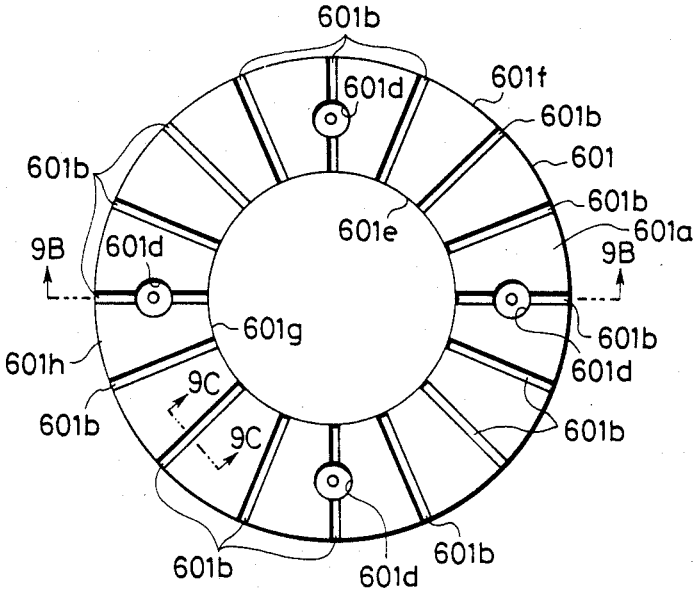
FIG. 9A is a plan view of an upper thrust bearing.
Figure 9B:
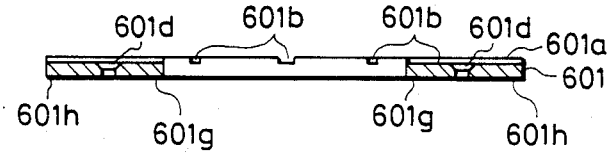
FIG. 9B is a cross section taken along a line 9B—9B in FIG. 9A.
Figure 9C:
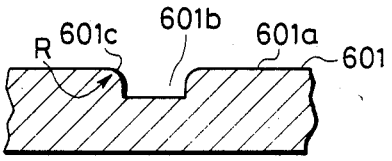
FIG. 9C is a cross section taken along a line 9C—9C in FIG. 9A.

FIGS. 9A to 9C show the structure of the upper thrust bearing 601, of which FIG. 9A is a plan view thereof, FIG. 9B is a cross section taken along a line 9B—9B in FIG. 9A, and FIG. 9C is an enlarged cross section taken along a line 9C—9C in FIG. 9A.

The upper thrust bearing 601, composed of a base of steel and a sliding layer of aluminum alloy or lead-bronze alloy formed on the seal base, takes the form of a doughnut, as shown in FIG. 9A. On an upper surface 601*a* of the thrust bearing 601, which is in sliding contact with the lower surface of the orbiting scroll 2, a plurality of equiangular radial oil grooves 601*b* are formed. Each oil groove 601*b* has a substantially rectangular cross section, as shown in FIG. 9C, edges of the groove 601*b* being rounded to form round portions 601*c* so that the lubricating oil can be easily spread over the sliding surface 601*a*. The angle between adjacent oil grooves 601*b* is selected such that it is smaller than twice the orbiting radius R of the orbiting scroll 2. 601*d* depicts rivet holes for mounting the thrust bearing 601, which intersect portions of the oil grooves 601*b*.

The outer diameter of the thrust bearing 601 is determined such that a turning moment produced by a composite force of a radial force and an axial force produced in the orbiting scroll 2 is received and a vector of the composite force passes a point at least inside the outer periphery of the thrust bearing 601. 601*e* depicts an inner peripheral surface of the thrust bearing 601, and 601*f* depicts an outer peripheral surface of the bearing 601.

Figure 10A:
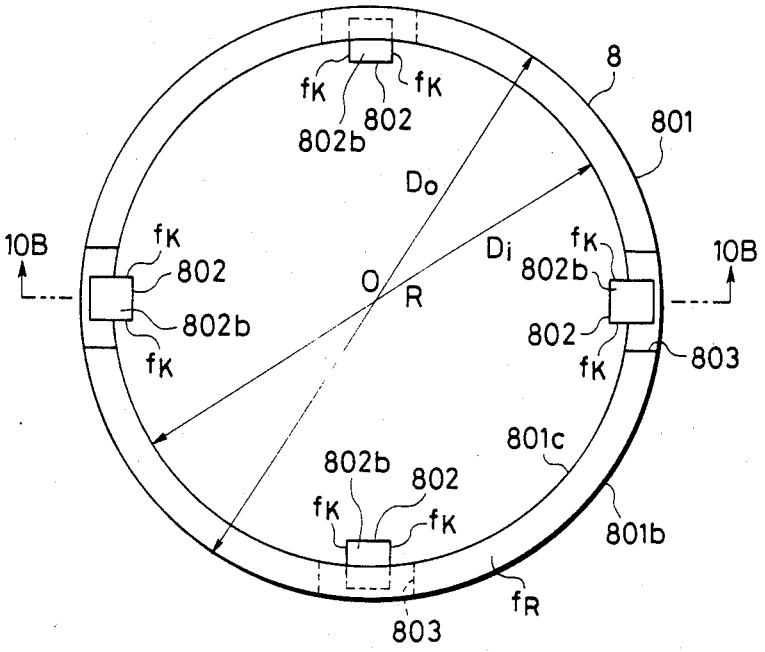
FIG. 10A is a plan view of an Oldhams coupling.
Figure 10B:
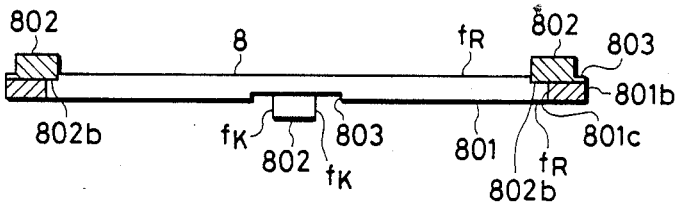
FIG. 10B is a cross section taken along a line 10B—10B in FIG. 10A.
Figure 11:
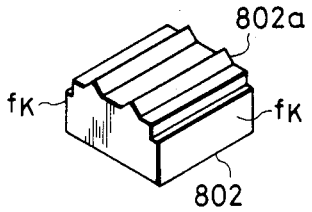
FIG. 11 is a perspective view of an Oldhams key of the Oldhams coupling.
Figure 12:
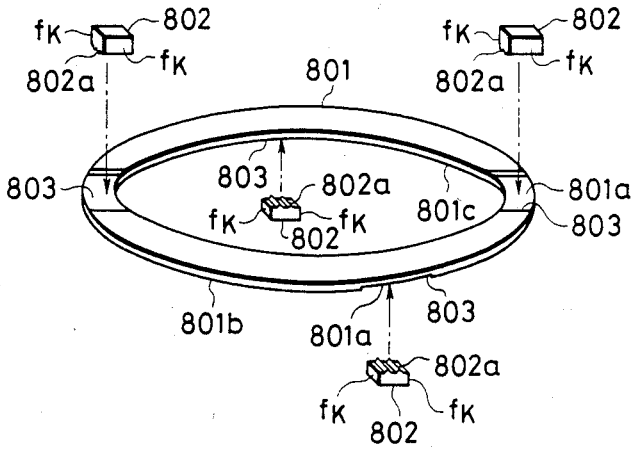
FIG. 12 is a disassembled perspective view of the Oldhams coupling.

FIGS. 10 to 12 show the Oldhams coupling used in this embodiment in detail, of which FIG. 10A is a plan view thereof and FIG. 10B is a cross section taken along a line 10B—10B in FIG. 10A. In these figures, 801 depicts the Oldhams ring having a rectangular cross-section, as shown in FIG. 10B, 802 two pairs of substantially cubic Oldhams keys, and 803 two pairs of relief portions formed in the upper and lower surfaces of the Oldhams ring 801 as grooves. One of the Oldhams key pairs are arranged in the relief grooves 803 formed oppositely in the upper surface of the Oldhams ring 801 and secured thereto, and the other pair of the Oldhams keys 802 are arranged in the relief grooves 803 formed oppositely in the lower surface of the Oldhams ring 801, forming a 90° angle with respect to the Oldhams keys 802 on the upper surface of the ring 801. The Oldhams keys 802 and the Oldhams ring 801 are made of a hard material such as tempered steel and have sliding surfaces $f_K$ and $f_R$, which should be polished. Therefore, the depth of the relief groove 803 is determined taking material removal by polishing into consideration The Oldhams keys 802 are positioned on the relief grooves 803 such that inner ends thereof protrude radially inwardly towards a center $O_R$ of the Oldhams ring 801. 802*b* depicts portions of the Oldhams keys 802 protruding inwardly from the Oldhams ring 801.

The Oldhams keys 802 and the Oldhams ring 801 are prepared separately and assembled by welding of the like. FIG. 11 is a perspective view of the Oldhams key 802, which has protrusions 802*a* on a surface portion thereof adapted to be connected to a connecting face 801*a* of the Oldhams ring 801 to provide a sufficient welding strength when the keys are connected by, for example, electric resistance welding.

Figure 13:
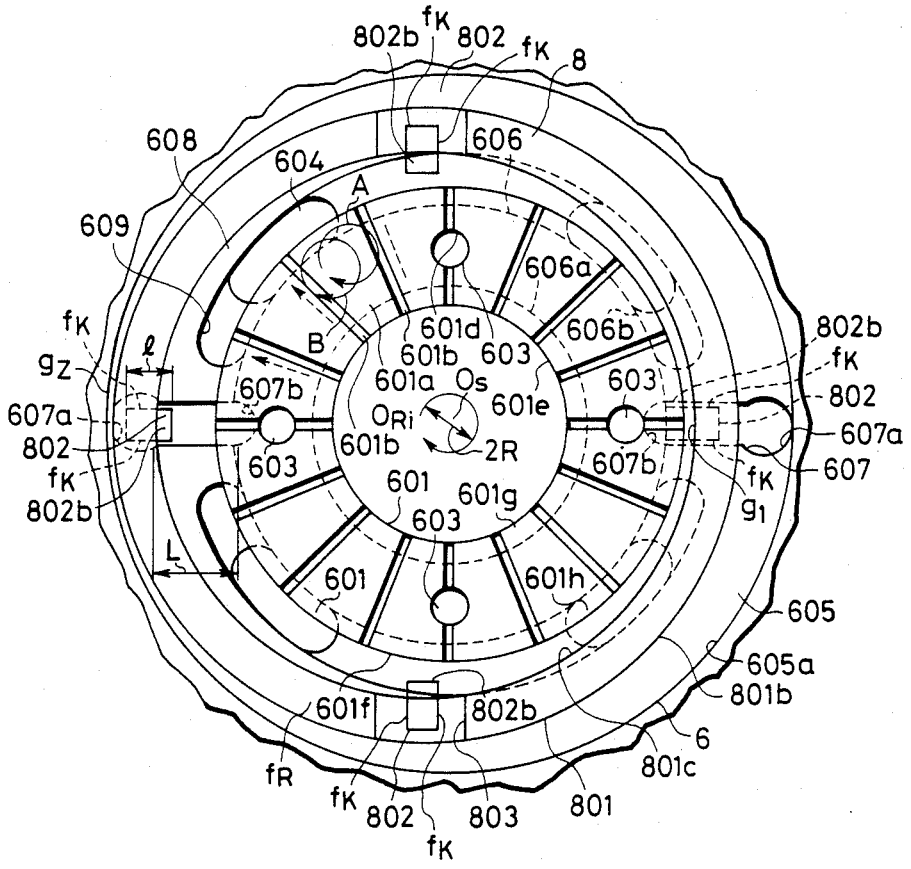
FIG. 13 is a plan view showing an assembly of the upper frame, the upper thrust bearing and the Oldhams coupling.
Figure 14:
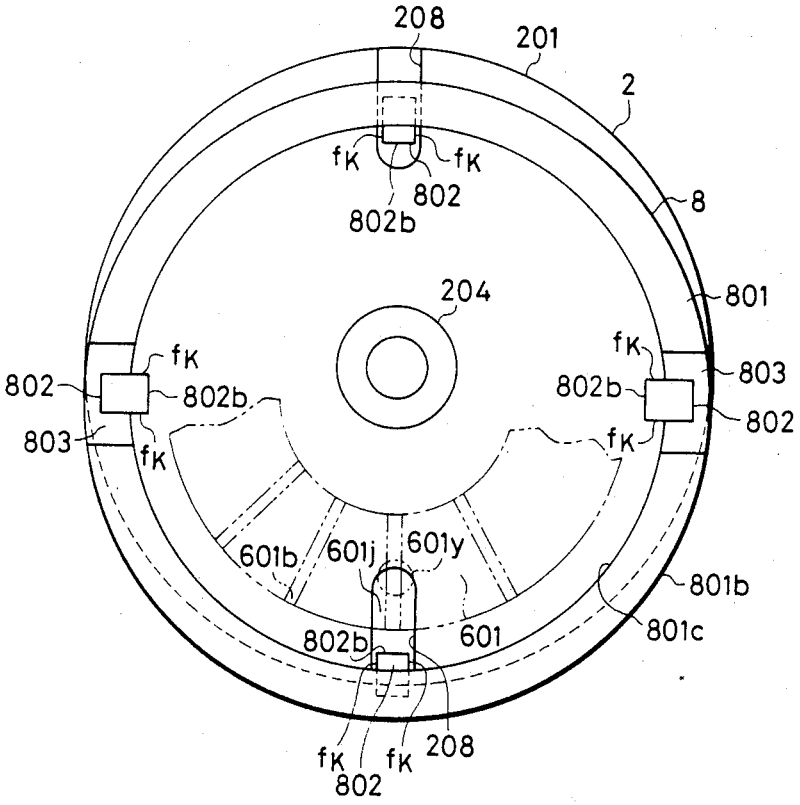
FIG. 14 is a bottom view showing an assembly of the orbiting scroll and the Oldhams coupling.

FIG. 13 is a plan view of the upper frame 6 to which the thrust bearing 601 and the Oldhams coupling 8 are assembled, and FIG. 14 is a bottom view of the orbiting scroll 2 to which the Oldhams coupling 8 is assembled.

In FIG. 13, the flat, annular thrust bearing 601 is attached to the upper surface of the mounting seat 606 of the upper frame 6 by the rivets 603. The inner peripheral surface 601*e* of the thrust bearing 601 overhangs inwardly of the inner peripheral surface 606*a* of the mounting seat 606, as shown by a dotted line, to form an overhanging portion 601*g*, and the outer peripheral surface 601*f* overhangs outwardly of the outer peripheral surface 606*b* of the seat 606 to form an overhanging portion 601*h*.

The Oldhams keys 802 on the lower surface of the Oldhams coupling 8 are slidably received in the guide grooves 607 on the upper surface of the upper frame so that the keys 802 are able to reciprocate along the guide grooves 607. The keys 802 on the upper surface of the Oldhams ring 801 are slidably received in the guide grooves 208 formed on the orbiting scroll 2 shown in FIG. 5C. FIG. 14 shows the latter. In FIG. 14, the orbiting scroll 2 is guided by the Oldhams keys 802 in the guide grooves 208 thereof to reciprocate vertically in the drawing. When the orbiting scroll 2 is driven, it orbits by a combination movement of the mutually orthogonal reciprocations of the Oldhams coupling 8 without rotation around its axis.

The range of the relative reciprocations of the Oldhams coupling 8 with respect to the upper frame 6 and the orbiting scroll 2 is 2R, which is the orbital diameter of the orbiting scroll 2. Therefore, a length L of a straight portion of the guide groove 607 of the upper frame 6 may be defined as $L \geqq l+2R$, where l is the length of the Oldhams key 802. However, it is difficult practically to machine the guide groove 607 with exactly right-angled corners. Accordingly, the relief portions 607*a* and 607*b* having a semi-circular plane configuration are provided at the opposite end portions thereof as shown in FIG. 13. The width of the guide groove 607 is the same as the diameter of the relief portion 607*b*, and is smaller than the diameter of the relief portion 607*a*, so that the Oldhams keys 802 are prevented from biting the Oldhams grooves 607 when they reciprocate therein. Further, the outer diameter $D_o$ (see FIG. 10) of the Oldhams ring 801 is substantially the same as the outer diameter $D_s$ (see FIG. 5) of the orbiting scroll 2. The inner diameter $d_i$ (FIG. 10) is determined such that, when the Oldhams ring 801 is completely shifted to either side, as shown in FIG. 13 in which the inner peripheral surface 801*c* of the Oldhams ring 801 is the closest to the outer peripheral surface 601*f* of the thrust bearing 601, a small gap $g_1$ (0.5–1 mm) is provided between the surfaces 801*c* and 601*f*. In the same way, the outer diameter $D_o$ of the Oldhams ring 801 is determined such that, when the Oldhams ring 801 is completely shifted to the opposite side and the peripheral wall surface 605*a* of the Oldhams chamber 605 is the closest to the outer peripheral surface 801*b* of the Oldhams ring 801, a small gap $_2$ (0.5–1 mm) is also provided between the surfaces 605*a* and 801*b*.

With arrangement, the outer diameter of the upper frame 6 is minimized, and thus the radial size of the compressor can be minimized. Further, with the portions 802*b* of the Oldhams keys 802 which protrude inwardly from the inner peripheral surface 801*c* of the Oldhams ring 801, it is possible to prevent the corner portions of the Oldhams keys 802 from interfering with the peripheries of the semi-circular relief portions 607*a* of the guide grooves 607 in the outer peripheral side of the Oldhams ring 801, as shown in FIG. 13. Since, at the inner peripheral side of the Oldhams ring 801, the protruded portion 802*b* of the Oldhams key 802 overlaps the outer-peripheral, overhanging portion 601*b* of the thrust bearing 601, it is possible to make the load area of the Oldhams key 802 large. Further, with the protruding portion 802*b*, the sliding load areas of the Oldhams key 802 and the guide groove 208 of the orbiting scroll 2 can be made large when the Oldhams ring 801 is shifted completely to one side, as shown in FIG. 14, resulting in an improved reliability of the sliding surfaces.

Next, the lubricating system for the thrust bearing 601 will be described. In FIG. 13, oil supplied to the oil grooves 601*b* of the thrust bearing 601 radially inwardly flows radially outwardly along the radial oil grooves 601*b*, as shown by dotted arrows. On the other hand, during the operation of the orbiting scroll 2, a certain point on the thrust plane of the orbiting scroll 2 rotates across one of the oil grooves 101*b* by the orbital diameter 2R of the orbiting scroll 2, as shown by an arrow A, and another certain point rotates across the adjacent oil groove 601*b* by the orbital diameter 2R, as shown by an arrow B. The distance between adjacent oil grooves 601*b* is selected as being smaller than the orbital diameter 2R of the orbiting scroll 2. Therefore, the sliding surface 601*a* between the adjacent oil grooves 601*b* is always supplied with oil from these oil grooves 601*b* and is kept sufficiently lubricated. This can be seen by the overlapping relation of the arrows A and B. In a portion 601*j* (FIG. 14) where the oil groove 601*b* and the rivet hole portion 601*d* of the thrust bearing 601 and the Oldhams guide groove 208 of the orbiting scroll 2 overlap each other, there is no oil film reactive force produced and no bearing load supported. Therefore, as shown in FIG. 14, by crossing the rivet hole 601*d* and a portion of the oil groove 601*b* and by overlapping the crossing portion and the guide groove 208 of the orbiting scroll 2, it is possible to prevent the loading capability of the thrust bearing 601 from being lowered. That is, since there is no oil film reactive force produced in the portion of the oil groove 601*b*, the rivet hole 601*d* and the overlapping portion 601*j* where there is no oil film reactive force produced are arranged in that oil groove portion 601*b* so that the load supporting capability of the thrust bearing is not significantly reduced.

Oil which is discharged radially outwardly by the thrust bearing 601 flows into the Oldhams chamber 605 to lubricate the Oldhams coupling 8, and then is discharged through the four oil discharging ports 604 in the bottom of the Oldhams chamber 605 to the balancer chamber 705. The relief grooves 609, each communicating two of the oil discharge ports 604 shown in FIG. 13, are arranged such that they are positioned radially inwardly of the outer peripheral surface 801*b* of the Oldhams ring 801 regardless of the position of the latter. The arrangement of the oil discharge grooves 604 and the relief grooves 609 is employed to prevent oil discharged radially outwardly of the thrust bearing 601 from flowing to the outside of the Oldhams coupling 8 and then to the suction port 104 of the compressing portion as shown in FIG. 3, and finally being discharged from the compressor itself. Various gaps formed between the upper frame 6, the Oldhams coupling 8 and the orbiting scroll 2 are made as small as possible to minimize the oil loss.

Figure 15A:
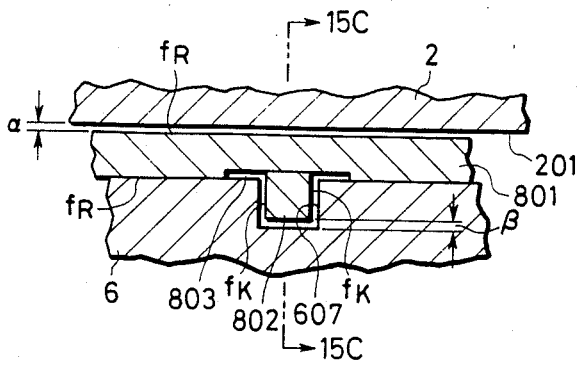
FIGS. 15A and 15B shows various gaps between the orbiting scroll, the Oldhams coupling and the upper frame when assembled.
Figure 15B:
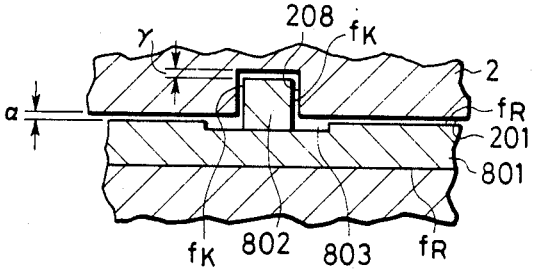
Figure 15C:
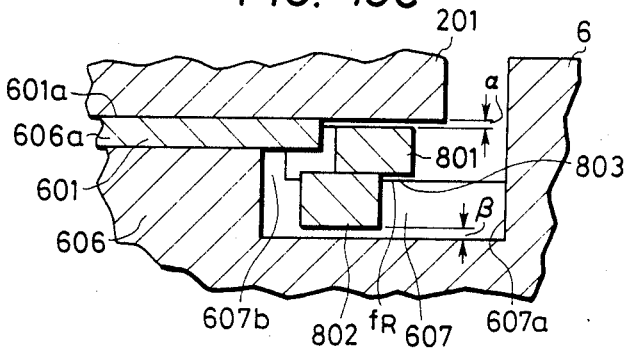
FIG. 15C is a cross section taken along a line 15C—15C in FIG. 15A.

FIG. 15 shows these gaps, including a gap $\alpha$ between the base plate 201 of the orbiting scroll 2 and the Oldhams ring 801, a gap $\beta$ between the Oldhams key 802 and the bottom surface of the guide groove 607 of the upper frame 6, and a gap $\gamma$ between the Oldhams key 802 and bottom surface of the guide groove 208 of the orbiting scroll 2. These gaps are very small, typically on the order of 0.1 mm.

FIGS. 16A to 16C show the structure of the main shaft 4, of which FIG. 16A is a cross section thereof before the first balancer 402 is mounted thereon, FIG. 16B is a side view thereof, and FIG. 16C is a side view thereof when the first balancer 402 is mounted thereon FIG. 17 is a plan view thereof before the eccentric bushing 5 is inserted thereinto, i.e., a view of the main shaft in FIG. 16C in a direction F. The main shaft 4 is made of a tempered steel, and the first balancer 402 is made of cast iron and pressure-inserted into the main shaft 4.

In these figures, 408 depicts an upper slide surface of the main shaft formed in an outer periphery of the enlarged diameter portion of the main shaft 4, 409 a lower slide surface of the main shaft formed in an outer periphery of the middle portion of the main shaft 4, 410 a lower slide surface of the thrust shaft formed in a lower surface of the enlarged diameter portion of the main shaft 4, 411 a first balancer insertion portion formed in the lower portion of the enlarged diameter portion of the main shaft 4, 412 a rotor insertion portion formed in the lower portion of the main shaft 4, 413 an oil cap insertion portion formed in the lowermost portion of the main shaft 4, 401 an eccentric hole formed in an upper end of the enlarged diameter portion of the main shaft 4, 404 an oil passage formed in the main shaft 4, 405, 406 and 414 oil holes, 415 an oil groove formed in a side surface of the enlarged diameter portion of the main shaft 4, 407 is a gas relief hole formed in the main shaft 4, 416 a center hole, 417 a snap ring groove formed in a peripheral wall of the eccentric hole 401, 418 a pin hole, and 419 a shoulder formed on the first balancer 402.

The first balancer insertion portion 411 has a diameter which is smaller than the diameter of the slide surface 408 of the main shaft 4. A step 411*a*, whose height corresponds to a difference in diameter between the portion 411 and the slide surface 408, restricts the axial position of the first balancer 402 when it is pressure-inserted. The diameter of the slide surface 409 is smaller than the diameter of the first balancer insertion portion 411, and a step formed by this difference of diameter forms the lower thrust bearing slide surface 410, i.e., the lower surface of the first balancer insertion portion 411. The diameter of the rotor insertion portion 412 is smaller than the diameter of the slide surface 409, and a step 412*a* formed thereby restricts the axial position of the rotor 10 (FIG. 3) when it is pressure-inserted. By changing the length of a portion of the main shaft 4 below the rotor insertion portion 412, it is possible to accommodate a series connection of a plurality of compressors to increase the overall capacity.

The slide surfaces 408, 409 and 410 and the insertion portions 411, 412 and 413 are coaxial and the eccentric hole 401 and the oil passage 404 are formed eccentrically with respect to the axis of the coaxial elements.

The eccentric hole 401 is formed in the upper end of the enlarged diameter portion of the main shaft 4 and the axial depth thereof is substantially the same as the axial length of the slide surface 408. The oil passage 404 has an upper end opened in the bottom surface of the eccentric hole 401 and a lower end opened in the lower surface of the reduced diameter portion of the main shaft 4 and extends parallel to the axis of the main shaft 4 with a predetermined distance between it and the main shaft axis.

Center holes 416 are formed in the bottom of the eccentric hole 401 and in the lower end of the reduced diameter portion, which are adapted to support the main shaft 4 when it is tempered and polished to thereby improve the machining precision. The center hole 416 formed in the lower end of the main shaft 4 is communicated with a lower end of the gas relief hole 407.

The oil hole 414 is formed radially to communicate the side wall of the eccentric hole 401 with the slide surface 408 of the main shaft 4. That is, the oil hole 414 is opened in the oil groove 415 formed in the slide surface 408. The oil hole 405 communicates the oil passage 404 with the slide surface 409. The oil holes 405 and 414 and the oil grooves 415 are preferably formed in the side opposite to a direction of a load which is a combination of centrifugal force and gas pressure. However, it is also possible to form an annular oil groove on an inner peripheral surface of a corresponding bearing and communicate it with the oil holes 405 and 414 to supply oil to the bearing if necessary.

The pin hole 418, formed in the bottom of the eccentric hole 401, is adapted to receive an anti-rotation spring pin 420 (FIG. 19 - described below) for preventing a reduction of compression due to over-rotation of the eccentric bushing 5 inserted into the eccentric hole 401.

The snap ring groove 417 is adapted to receive a snap ring 421 (FIG. 19) used for preventing the eccentric bushing 5 from being pushed up axially due to the pressure of oil being forced up through the oil passage 404 by centrifugal pump action.

FIGS. 18A to 18C show in detail the construction of the eccentric bushing 5 inserted into the eccentric hole 401, of which FIG. 18A is a plan view, FIG. 18B is a vertical cross section, and FIG. 18C is a bottom view. 501 indicates an outer peripheral surface of the eccentric bushing whose center is $O_{Bo}$. 502 denotes an inner peripheral surface of the eccentric bushing whose center is $O_{Bi}$. The center $O_{Bi}$ is eccentric with respect to the center $O_{Bo}$ by $\epsilon$. 503 depicts a shoulder formed on the outer periphery 501, which is coaxial with the center $O_{Bi}$ and whose diameter is smaller than the outer peripheral surface 501. 504 depicts a shoulder formed on the inner periphery 502, which is coaxial with the center $O_{Bi}$ and whose diameter is larger than that of the inner peripheral surface 502. 505 depicts a longitudinal oil groove having a lower end opened in the lower end of the eccentric bushing and an upper end closed, which is opened to the outer peripheral surface 502. 506 depicts an oil hole for communicating the oil groove 505 with the outer peripheral surface 502, and 507 depicts a notch formed on the outer peripheral surface 501 to which a radial end of the oil hole 506 is opened. 508 depicts a hole formed in the lower end of a thicker portion of the eccentric bushing 5 for receiving an anti-rotation member. The eccentric bushing 5 is made of a bearing material such as aluminum alloy or lead-bronze.

FIG. 19 is a perspective view of the eccentric bushing 5 and the main shaft 4 for explaining an assembling thereof. In FIG. 19, a spring pin 420 in the form of a pipe, having a substantially C shape, is fitted in the pin hole 418 in the bottom of the eccentric hole 401 of the main shaft 4, and then the eccentric bushing 5 is fitted in the eccentric hole 401 such that the spring pin 410 fits in the anti-rotation hole 508 formed in the lower portion of the bushing 5. With the spring pin 520 fitted in the anti-rotation hole 508 and the lower end of the eccentric bushing 5 in contact with the bottom of the eccentric hole 401, the snap spring 421 is fitted in the snap ring groove 417. The snap ring 421 is formed by bending a resilient wire such as piano wire to a C shape.

FIG. 20 shows the eccentric bushing 5 assembled with the main shaft. In FIG. 20, $O_s$ depicts an axis, i.e., a rotation center of the main shaft 4, which coincides with the center of the stationary scroll 1. The position of the spring pin 420 is determined such that the center $O_{Bo}$ is set in a position where a straight line connecting the center $O_s$ to the center $O_{Bi}$ of the inner peripheral surface 502 of the eccentric bushing 5 makes substantially a right angle to a straight line connecting the center $O_{Bi}$ and the center of the outer peripheral surface 501. The diameter of the anti-rotation hole 508 is larger than the diameter of the spring pin 420 so that the eccentric bushing 5 can move peripherally to a certain extent. The peripheral length of the notch 507 is selected such that the oil hole 506 of the eccentric bushing 5 and the oil hole 414 of the main shaft 4 are always communicated, regardless of the rotation of the eccentric bushing 5.

The orbiting shaft 204 of the orbiting scroll 2 is inserted into the eccentric bushing 5 such that the outer peripheral surface of the orbiting scroll shaft 204 is slidable with respect to inner peripheral surface 502 and, therefore, the center $O_{Bi}$ of the inner peripheral surface of the bushing coincides with the orbital center, i.e., the center of gravity of the orbiting scroll 2. Thus, when the main shaft 4 rotates in the direction of an arrow W, a centrifugal force in an arrow G direction is produced on a straight line connecting the rotation center $O_s$ of the main shaft 4 to the center $O_{Bi}$ of the inner peripheral surface 502 of the bushing and a moment acting in the M direction is produced on the eccentric bushing 5, the center of the moment being the center $O_{Bo}$ of the outer peripheral surface 501 of the bushing. Therefore, when a gap exists between the wraps 102 and 202 of the stationary scroll 1 and the orbiting scroll 2, the eccentric bushing 5 rotates around the center $O_{Bo}$ of the outer peripheral surface 501 of the eccentric bushing 5 in the M direction so that the orbiting scroll 2 shifts until the wraps 102 and 202 are in contact with each other.

Movement of the above-mentioned center position will be described with reference to FIG. 21. The eccentric bushing 5 rotates around the center $O_{Bo}$ of the outer peripheral surface 501 in the M direction, and the center $O_{Bi}$ of the inner peripheral surface 502 of the bushing 5 moves to a point $O_{Bi}'$ at which the wraps 102 and 202 are in contact with each other. That is, the orbital radius of the orbiting scroll 2 varies from $O_sO_{Bi}=R$ to $O_sO_{Bi}'=R'$. If the orbital radius is smaller than R due to machining conditions, the eccentric bushing may rotate in the direction opposite to the arrow M. This may be true in cases of oil returning or alien substances between the wraps 102 and 202.

In this manner, the eccentric bushing 5 absorbs variations of machining inaccuracy, facilitating assembly and preventing compressed coolant gas from leaking through the gaps between the wraps 102 and 202 in the wrapping direction during compression operation, resulting in an improved compression efficiency. The eccentric bushing 5 is durable against the return oil or foreign matter between the wraps and, thus contributes to the improvement of reliability.

FIGS. 22A and 22B are explanatory drawings showing oil supply during rotation of the eccentric bushing 5. FIG. 22A shows a state in which the eccentric bushing 5 is rotated clockwisely until the anti-rotation hole 508 and the pin 420 are in contact with each other. The length and position of the notch 507 are selected such that the oil hole 414 of the main shaft 4 communicates with the oil hole 506 of the eccentric bushing 5 even in this state. FIG. 22B shows another state in which the eccentric bushing 5 rotates oppositely. The length and position of the notch 507 are set to provide communication between the oil holes 506 and 414 even in this state.

FIG. 23 shows another embodiment of the eccentric bushing 5 in which the oil passage 404 is formed in a position rotated clockwise around the center $O_{Bi}$ by 90° with respect to the embodiment shown in FIGS. 3 to 22. In this embodiment, when the main shaft 4 is rotated around the center $O_s$ in a direction shown by a solid arrow, oil flows in a direction shown by a dotted arrow. Therefore, the distance from the oil passage 404 to the oil groove 505 of the bushing 5 is shortened, and thus the response of the centrifugal pump action by the main shaft 4 is improved.

FIG. 23 further includes an anti-rotation and anti-floating mechanism for the eccentric bushing 5. In upper end surfaces of the eccentric bushing 5 and the main shaft 4 are formed with grooves 509 and 422, respectively. A stopper plate 423 is secured by a screw 424 to the groove 422 of the main shaft 4. The amount of rotation of the eccentric bushing 5 is restricted by a narrowed, inward protrusion 423*a* of the stopper plate 423 in the same way as that restricted by the combination of the pin 420 and the anti-rotation hole 508 in the previous embodiment. Further, it functions to prevent the eccentric bushing 5 from floating up in a similar action to that of the snap ring groove 417 and the snap ring 421. FIG. 24 explains the assembling of the structure shown in FIG. 23. After the eccentric bushing 5 is inserted into the eccentric hole 401 of the main shaft 4 such that the grooves 422 and 509 are aligned, the stopper plate 423 is fitted in the groove 422 with opposite side faces being in contact with side surfaces of the groove, respectively, and is screwed by the screw 424 to the groove.

FIG. 25 shows an oil supply system around the main shaft 4. According to the centrifugal pump action provided by the oil cap 12 and the main shaft 4 shown FIG. 3, oil moves upwardly along the oil passage 404, as shown by a dotted line, and flows into the space 425 of the eccentric hole 401. The position of the oil groove 505 of the eccentric bushing 5 is radially outwardly of the oil passage 404 positioned radially outwardly of the center of the main shaft 4. Therefore, the oil therein is subjected to a second centrifugal pumping action and moves upwardly along the oil groove 505. Oil in the oil groove 505 further moves upwardly along the oil groove 415 due to a third centrifugal pumping action in the oil holes 506 and 414. Since the oil groove 415 is not opened to the lower portion of the main bearing 602, oil does not enter the balancer chamber 705. Thus, oil flows into the space 426 defined by the thrust bearing 601 and the upper portion of the main shaft 4, and then through the oil grooves 601*b* of the thrust bearing 601 to the Oldhams chamber 605. In FIG. 25, the oil flow is shown by dotted arrows The lower thrust bearing 701 and the lower main bearing 702 are supplied with oil passed through the oil hole 405 shown in FIG. 3.

With this oil supply system, oil can be stably and continuously supplied, even when the compressor is operated at a low speed, since a reduced centrifugal pumping action by the oil cap 12 due to the reduced speed of the compressor can be compensated for by a sufficient negative pressure in the space 426 due to the second and third centrifugal pumping actions There may be cases where the main shaft moves axially due to vibration during, for example, transportation of the compressor In such a case, the upper end surface 427 of the main shaft 4 may hit the thrust surface 217 of the orbiting scroll 2, causing the latter to be damaged In order to solve this problem, a gap $l_1$ between the upper end face 427 of the main shaft and the thrust surface 217 of the orbiting scroll is made larger than a gap $l_2$ between the upper face of the shoulder 419 of the first balancer 402 and the lower end face 616 of the upper frame 6, as shown in FIG. 25, so that, when the main shaft 4 is moved axially upwardly, the upper end face of the shoulder 419 contacts the lower end face 416 of the upper frame and the upper end 427 of the main shaft 4 cannot contact the thrust surface 217 of the orbiting scroll 2. Alternatively, it is possible to make a gap $l_3$ between the rotor 10 and the cylindrical support 7*b* of the lower frame 7 smaller than the gap $l_1$. In such a case, however, it may be difficult to make the space 426 sufficiently large in view of pumping efficiency. Therefore, it is preferred to regulate the gap $l_2$.

Since the overhanging portions $601_g$ and $601_h$ of the inner and outer surfaces 601*e* and 601*f* of the thrust bearing 601 and the step 503, which is the overhanging portion of the eccentric bushing 5, are slightly deformed according to a tilting or deformation of the orbiting scroll 2 due to the turning moment acting on the scroll 2, uneven loading of the bearings 5 and 601 is prevented.

Since the overhanging portion 615 of the main shaft 4 over the cut portion 6*a* of the inner upper edge of the upper frame 6 can deform slightly due to tilting of the main shaft 4 due to a moment caused by the centrifugal forces of the first and second balancers 402 and 403 and the radial gas load, uneven supporting of the bearing surface of the main bearing 4 is prevented. Further, since the lower end 702*a* of the lower main bearing 702 protrudes over the lowermost support end 7*b'* of the cylindrical bearing support 7*b* of the lower frame 7, the lower end 702*a* can deform slightly when the main shaft 4 is tilted, and thus uneven support of the bearing 702 is prevented.

FIGS. 26A to 26C shows structures by which an excessive increase of oil pumping due to high speed operation of the compressor is restricted. In FIG. 26A, the amount of oil to be discharged radially outwardly of the thrust bearing 601 is increased when the vertical oil groove 415 in the main shaft 4 coincides with any of the radial oil grooves 601*b* of the thrust bearing 601 and decreased when the groove 415 does not coincides with the groove 601*b* (dotted line). That is, when the rotational speed increases, the flow resistance also increases due to the chopper effect, and thus the amount of oil discharged, i.e., pumped up, is relatively restricted. In this case, it is preferable to make the gap between the inner peripheral surface of the thrust bearing 601 and the outer peripheral surface of the main shaft 4 smaller than the peripheral groove width of the oil groove 601*b* of the thrust bearing.

FIGS. 26B and 26C show another embodiment, of which FIG. 26B is a plan view and FIG. 26C is a cross section taken along a line 26C—26C in FIG. 26B. In this embodiment, the inner diameter of the thrust bearing 601 is made smaller than the outer diameter of the main shaft 4, a gap 601*k* is formed between the lower surface of the thrust bearing 601 and the upper surface of the main shaft 4, and a nctch 601*m* is formed in the inner end portions of the radial oil grooves 601*b* of the thrust bearing 601 in overlapping relation to the oil groove 415 of the main shaft 4. With this structure, the chopper effect is further improved compared with that shown in FIG. 26A.

FIGS. 27A and 27B show another embodiment of the oil supply system for the lower main bearing 702, and FIG. 28 shows a further embodiment thereof In these figures, dotted arrows show oil flows In FIGS. 27A and 27B, of which FIG. 27A is a cross section of the oil supply system and FIG. 27B is a plan view of the slide surface 701*a* of the lower thrust bearing 701, oil pumped up to the oil passage 401 and which flows into the space 425 is supplied through the oil hole 406 penetrating the first balancer to the lower thrust bearing 701 in which a plurality of radial oil grooves 701*b* are provided. Each radial oil groove 701*b* has an inner end opened and an outer end closed as shown in FIG. 27B. 701*c* depicts a pin hole for keying the lower thrust bearing. The oil grooves 701*b* are arranged such that the oil hole 406 communicates therewith intermittently during the rotation of the main shaft 4. As a result, oil flowing from the oil hole 406 to the oil grooves 701*b* intermittently moves down along the inner surface of the cylindrical bearing support 7*b* of the lower frame 7 and the outer surface of the main shaft 4 by gravity and into the lower main bearing 702. In order to make the oil supply reliable, an oil groove 428 is formed in a side of the lower slide surface of the main shaft 4 opposite to the load side thereof.

In FIG. 28, showing another embodiment, an oil hole 429 is formed in the main shaft 4, which extends in parallel to the oil passage 401 and has an upper end opened to the bottom of the eccentric hole 401 and a lower end opened to the inner surface of the lower main bearing 702. In this case, oil pumped up along the oil passage 464 flows into the space 425 and a portion thereof moves down, by gravity and/or centrifugal force, through the oil hole 429 to the lower main bearing 702.

The embodiments shown in FIGS. 27 and 28 provide an improved pumping efficiency and response compared with that shows in FIG. 3 in that gas accumulated in the space 425 can be discharged effectively together with oil to the lower main bearing 702 through the oil supply system.

The oil cap 12 will be described in more detail with reference to FIGS. 29A, 29B, 30A and 30B. The oil cap 12 shown in FIG. 3 is important when the oil supply is performed by centrifugal pumping action. Oil entering the oil cap 12 is subjected to a centrifugal force due to rotation of the oil cap 12. When the oil temperature increases or the viscosity thereof is low, the slip between the oil and the inner surface 12*a* of the oil cap 12 increases, causing the pumping efficiency to be lowered. In order to prevent such a problem, the embodiments shown in FIGS. 29 and 30 are provided with special structures FIG. 29A is a cross section of the oil cap 12 formed in the inner surface 12*a* thereof with equiangularly arranged radial fins 12*b*, and FIG. 29B is a cross section taken along a line 29B—29B in FIG. 29A. The number of the fins 12*b* may be arbitrary, and even a single fin 12*b* may be acceptable. The position or positions of the fin 12*b* should be determined taking care that an oil inlet 12*c* of the oil cap 12, the gas discharge hole 407 and the oil passage 404 are not obstructed.

FIG. 30A is a cross section of another embodiment of the oil cap 12, which cooperates with a notch passage 430 formed in the lower end surface of the main shaft 4, which extends from the center of the latter radially outwardly, and FIG. 30B is a cross section taken along a line 30B—30B in FIG. 30A. In these figures, the notch passage 430 communicates the gas discharge hole 407 formed along the axis of the main shaft 4 with the oil passage 404. With this construction, slip is more effectively prevented comparing with the oil cap shown in FIG. 29.

Figure 1A:
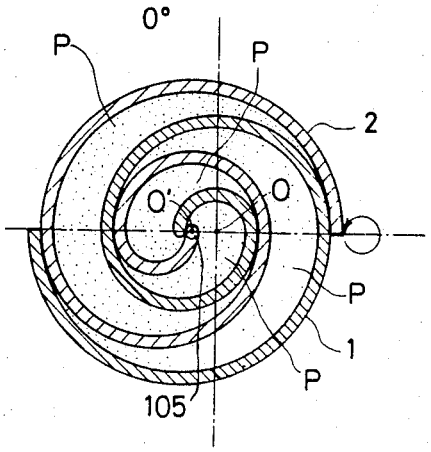
FIG. 1A PRIOR ART
FIGS. 1A to 1D illustrate an operating principle of a scroll-type compressor.
Figure 1D:
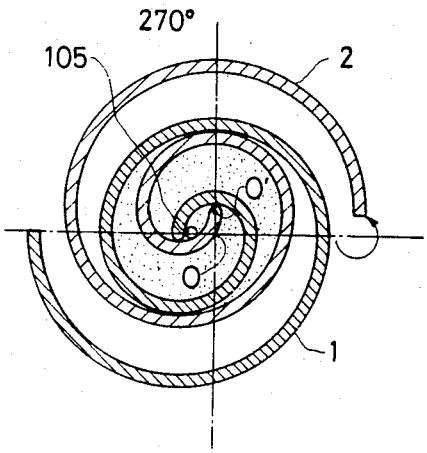
FIG. 1D PRIOR ART
Figure 1B:
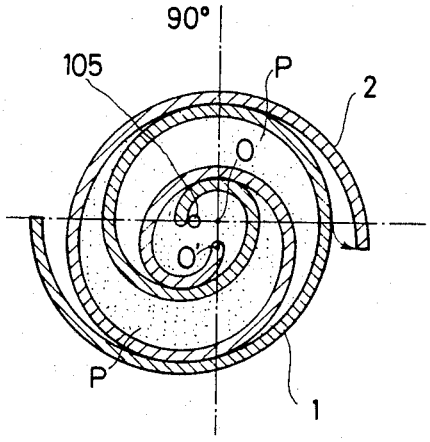
FIG. 1B PRIOR ART
Figure 1C:
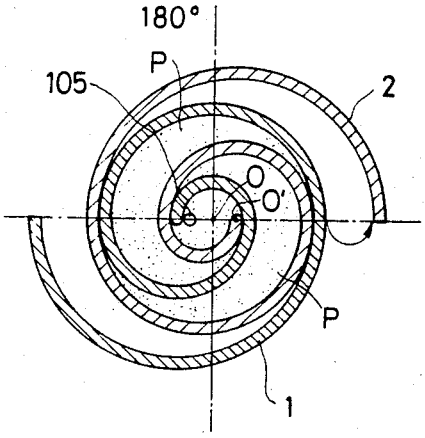
FIG. 1C PRIOR ART
Figure 2:
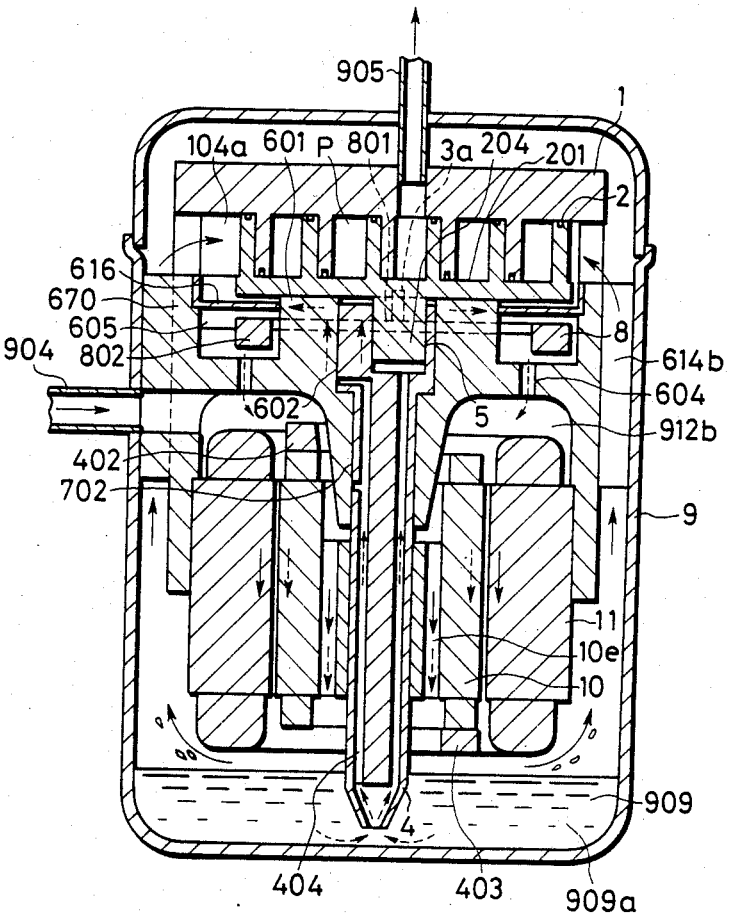
FIG. 2 PRIOR ART
FIG. 2 is a cross section of a conventional scroll-type compressor.

FIG. 31A shows an example of an electric power feeding system for the stator winding 11*a* of the motor and the wiring of control leads to the motor temperature detecting thermostat, FIG. 31B is a cross section taken along a line 31B—31B in FIG. 31A, and FIG. C is a perspective view of a pressure plate used therein In FIGS. 31A and 31B, one of the recesses 109 of the stationary scroll 1 is used for passage of a lead bundle 100 composed of a lead wire 100*a* for feeding the stator winding 11*a* of the motor stator 11, a control lead wire 100*b* to be connected to the motor temperature detecting thermostat, and a flexible insulating tube 100*c* covering these lead wires. The lead wire bundle 100 is held by a pair of oppositely extending small protrusions 110*b* formed on opposing edges of adjacent lands 110 of the stationary scroll 1, as shown in FIG. 31B. The holding of the lead wire bundle 100 is made more reliable by using the pressure plate 100*d* shown in FIG. 31C. The plane configurations of the upper and lower frames 6 and 7 are made substantially the same as that of the outer periphery of the stationary scroll 1. A notch 6*a* is formed in the outer periphery of the upper frame 6, and a notch 7*g* is formed in the outer periphery of the lower frame 7. The notches 109, 6*a* and 7*g* are overlapped with each other to form a vertical groove 100*e*. The lead wire bundle 100 is disposed in and along the groove 100*e* and then held in place by the pressing plate 100*d* with the aid of the protrusions 110*b* of the stationary scroll 1. The pressing plate 100*d* is formed from a thin resilient plate of such as spring steel and is fitted in the groove 100*e* formed by the recesses 109, 6*a* and 7*g* under a bent condition a shown. Therefore, the plate 100*d* is prevented from the groove 100*e* by its resiliency With this construction, degradation of the insulation of the lead wires is prevented because it does not contact directly with a high temperature welded portion 902*a* formed by welding the intermediate cylindrical portion 901 of the shell and the upper cover 902 thereof. 6*b* depicts a small protrusion formed at a top portion of the inner wall of the notch 6*a* such that it overlaps with the protrusion 110*b* of the stationary scroll 2, 7*h* depicts a similar protrusion formed at a top portion of the inner wall of the notch 7*g* such that it overlaps with the protrusion 6*b* of the upper frame 6, and 6*c* depicts a gap formed between the outermost portion of the upper frame 6 and the inner surface of the intermediate cylindrical portion 901 of the shell to prevent heat from being transmitted from the weld portion 902*a* to the upper frame 6. 110*c* depicts a space formed between the outermost portion of the stationary scroll 1, the intermediate portion 901 of the shell, and the upper cover 902 thereof to prevent heat from being transmitted from the weld portion 902*a* to the stationary scroll 1. Since the lead wire portion constituted by the bundle 100 and the pressing plate 100*d*, etc., is arranged remote from the opening of the coolant gas inlet tube 904 to the inside of the intermediate cylindrical portion 901, the tube 904 is shown by a dotted line. The lead wire 100*a* is plugged into the sealing terminal 907 shown in FIG. 2, and the lead wire 100*b* is plugged into another sealing terminal (not shown) provided on the upper cover 902 of the shell remotely from the sealing terminal 907. The pressing plate 100*d* is composed of a guard portion 100*d*-1, which contacts the upper surface of the stationary scroll 1, and three holes 100*d*-2 formed therein to facilitate the bending thereof.

FIG. 32 shows another embodiment of the compressor according to the present invention. In FIG. 32, 1 is a stationary scroll, 101 a base plate of the stationary scroll 1, 102 a wrap formed on the base plate 101, 2 an orbiting scroll, 201 a base plate of the orbiting scroll 2, 202 a wrap formed on the base plate 201, and 204 a shaft formed on an opposite surface of the base plate 201 to the wrap 202, compression chambers P being formed between the wraps 102 and 202. Pi is a suction chamber and 105 is a discharge port. On ends of the wraps 102 and 202, respective grooves 103 and 203 which extend along the wraps are formed. Tip seals 3 are inserted vertically movably in the grooves 103 and 203. 4 is a main shaft, 401 an eccentric hole formed in one end of the main shaft 4 eccentrically to an axis of the shaft, 404 an oil hole penetrating the main shaft 4 axially, 12 an oil cap formed integrally with the lower end of the main shaft 4 or secured thereto suitable by pressure insertion etc., and 407 is a gas relief hole for the oil cap 12 which communicates the lower end of the main shaft 4 with the side surface thereof. An eccentric bushing 5 is fitted rotatably in the eccentric hole 401 of the main shaft 4. The eccentric bushing 5 is formed with an eccentric hole 502 which supports the scroll shaft 204 of the orbiting scroll 2 slidably. 670 is a frame for supporting directly and indirectly the stationary scroll 1, the orbiting scroll 2 and the main shaft 4, etc., 670*a* a boss portion protruding integrally from a center portion of the frame 670 downwardly, 670*b* a cylindrical skirt portion formed integrally on the outer periphery of the frame 670, 607 a pair of Oldhams grooves formed on an upper surface of the frame 670 along a diameter thereof, 604 a plurality of radial oil return holes communicating the upper surface of the frame 670 with the lower surface thereof, and 8 an Oldhams coupling for preventing rotation of the orbiting scroll 2 around its axis. The Oldhams coupling 8 includes an Oldhams ring 801 and two pairs of Oldhams keys 802, one pair on the upper surface of the Oldhams ring 801 and the other pair on the lower surface thereof and being orthogonal to the one pair. 601 is a first thrust bearing, secured to the frame 670 by screws or pins, for supporting base plate 201 of the orbiting scroll 2 slidably. A plurality of equiangular radial oil grooves 601*b* are formed on a sliding surface of the first thrust bearing 601 to enhance the oil supply. 701 is a second thrust bearing secured to the frame 670 by screws or pins for supporting the main shaft 4 axially, 602 a first main bearing secured to the frame 670 by pressure-insertion, etc., for supporting the main shaft 4 rotatably, and 702 a second main bearing secured to the boss portion 670*a* of the frame 670 by pressure-insertion, etc., for supporting the main shaft 4 rotatably. An oil hole 404 is formed in the main shaft 4 for supplying oil to the second thrust bearing 701, the first main bearing 602 and the second main bearing 702. 11 is a stator of a motor, which is secured to the skirt portion 670*b* of the frame 670 by bolting, pressure-insertion or heat fitting, etc. 10 is a rotor of the motor secured on the main shaft 4 by pressure-insertion or heat fitting, etc., in a facing relation to the stator 11. The skirt portion 670*b* of the frame 670 is formed with a passage 670*c* so that gas taken in can flow downwardly along the outer periphery of the stator 11. A first balancer 402 is mounted fixedly on an upper end of the rotor 10 in an opposite side to the side in which the eccentric hole 401 of the main shaft 4 is formed, and a second balancer 403 is mounted fixedly on a lower end thereof in the side opposite to the first balancer 402.

The elements mentioned above are housed in a lower shell 9013 to which the frame 670 in secured by pressure insertion or heat fitting, etc. 902 is an upper shell which is secured to the lower shell 9013 by welding to form an air-tight shell for the compressor. 909*a* is lubricant oil pooled in a bottom of the lower shell. 904 is a suction pipe fitted in a hole 670*e* of the shirt portion 670*b* of the frame 67 and penetrating the side surface of the lower shell 9013 to communicate with the passage 670*c* for conducting the suctioned gas into the shell. 614 depicts a plurality of equiangular radial recesses formed in the outer periphery of the frame 670 for forming a gas passage 614*b* communicated with the inner surface of the lower shell 9013, the vertical suction chamber Pi and the suction pipe 904. 905 is a discharge pipe for guiding discharge gas from the discharge chamber 105 to the outside of the compressor.

FIG. 33 shows a portion of the embodiment in FIG. 32 in detail. In FIG. 33, 208 depicts two pairs of radial Oldhams grooves formed in the outer peripheral portion of the lower surface of the base plate 201 of the orbiting scroll 2, and 601*b* depicts a plurality of equiangular radial oil grooves formed in the first thrust bearing 601. Other reference numerals depict the same elements as described previously.

Describing the scroll compressor constructed as shown in FIGS. 32 and 33, when the stator 11 is activated, the rotor 10 rotates and thus the main shaft 4 is rotated. When the main shaft 4 rotates, the eccentric bushing 5 received in the eccentric hole 401 formed in the end portion of the main shaft 4 is also rotated to force the orbiting scroll 2 to rotate via the scroll shaft 204 received in the eccentric bushing 5. However, since, as shown in FIG. 33, the pairs of mutually orthogonal pins 802 of the Oldhams coupling 8 fit in the Oldhams grooves 607 of the frame 670 and the Oldhams grooves 208 of the orbiting scroll 2 slidably, the orbiting scroll 2 is always kept at a predetermined angle with respect to the frame 670. Therefore, the orbiting scroll 2 orbits without rotating around its axis and preforms compression as shown in FIGS. 1 to lD. It should be noted that the performance of the compressor depends upon the sealing of gas between the respective compression chambers and the radial sealing during the compression strokes thereof. In this embodiment, gas sealing between the compression chambers is realized by the tip seals 3 provided in the end of the scroll wraps, and radial sealing is realized by the provision of the eccentric bushing 5. With the compression operation, the coolant gas is taken in through the suction pipe 904 to an upper portion of the stator 11 and, after cooling the stator winding 11*a*, flows through the passage 670*c* and the gas passage 614*b* to the suction chamber Pi, sent to the compression chamber P, compressed, and then discharged through the discharge pipe 905.

Describing the lubricating oil system, the oil in the oil cap 12 is subjected to a centrifugal force due to the rotation of the main shaft and the oil cap 12, and therefore it is pushed up through the oil hole 404. A portion of the oil is supplied through the oil holes 405 and 406 to the second main bearing 702 and the second thrust bearing 701, respectively, before it reaches the upper end of the main shaft 4. The oil supplied to the main bearing 602 and the eccentric bushing 5 is discharged radially through the oil grooves 601*b* of the first thrust bearing 601. Since the Oldhams coupling 8 has a small space S defined by the inner surface of the Oldhams ring thereof, the upper surface of the frame 607 and the base plate 201 of the orbiting scroll 2, oil discharged radially of the first thrust bearing 601 and entering the small space S is returned to the upper portion of the stator 11 without entering into the suction chamber Pi and returned through the passage 670*c* to the oil reservoir 909. With the orbital movement of the orbiting scroll 2, the scroll compressor may have a tendency to vibrate due to mechanical unbalance thereof. However, the first and second balancers 402 and 403 provide static and dynamic balancing of the compressor, and thus such abnormal vibration is prevented.

Another embodiment of the present invention will be described with reference to FIGS. 34 and 35.

In FIG. 34, 6 depicts a first frame, 67*a* a socket-and-spigot joint formed in a lower side of the first frame 6, 609 a pair of arc grooves formed in an upper side of the frame 6, the arcs having the same center as that of the frame, 607 a pair of Oldhams grooves formed radially in the upper surface of the first frame 6, and 604 a plurality of radial oil returning holes each having an upper end opened to the arc groove 609 and extending through the first frame 6 axially. 614*b* depicts gas passages defined by a plurality of radial recesses 600*c* formed in an outer peripheral portion of the first frame 6 and the inner peripheral surface of a lower shell 9013, which acts as a passages for gas taken in during the compressor operation. 602 is a first main bearing arranged coaxially with the joint 67*a*. 7 is a second frame, 7*b* is a boss portion protruding downwardly from a center portion of the second frame 7 into a counter bore 10*b* formed in an upper center portion of a rotor 10 of a motor to be described, 7*d* a plurality of motor mounting legs extending from the outer periphery of the second frame 7 downwardly and 7*g* an oil returning groove formed in an outer surface of at least one of the motor mounting legs 7*d* and communicating with a recess 705 formed in the upper surface of the second frame 7. The diameter of the second frame 7 is slightly larger than the diameter of the first frame 6 so that it can be pressure-inserted or heat-fitted to the shell 9013. The second frame 7 is formed in the outer periphery thereof with a plurality of axial gas passages 614*b*, as in the case of the first frame 6. 7*h* is a partition wall for closing the upper end of one of the gas passages 614*b*, and 76*b* is a socket-and-spigot joint formed in the upper side of the second frame 110. 702 is a second main bearing secured to the top end portion of the boss 7*b* by pressure-insertion, and is coaxial with the joint 76*a*. The first and second frames 6 and 7 are arranged such that the joints 67*a* and 76*a* are intimately fitted to each other. Therefore, when the compressor is assembled, the first main bearing 602 and the second main bearing 702 are exactly coaxial and can support the main shaft slidably. 402 is a first balancer protruding from the main shaft 4 so that it is housed in a balancer chamber 705 defined by a recess formed in the upper surface of the second frame 7. In this embodiment, the first balancer 402 is formed integrally with the main shaft 4. It is also possible to prepare the first balancer 402 separately from the main shaft 4 and secure it to the latter by bolts or heat-fitting. 11 is a stator of a motor, which is secured by bolts 704 to the lower ends of the motor mounting legs 7*d*. 10 is a rotor of the motor, which is fixedly secured to the main shaft 4 in a position offset upwardly with respect to the stator 11. An upper center portion of the rotor 10 has a counter bore 10*b* so that the boss 7*b* of the frame 7 can be extended thereinto and a lower end of the rotor 10 is provided with a second balancer 403. 106 depicts bolts for fixing the stationary scroll 1, the first and second frames 6 and 7 together. 901 is a disc-shaped anti-foaming plate provided above an oil reservoir 909*a* and having a periphery spot-welded to the lower shell 9013, and 910*b* is a single hole or a plurality of small holes formed in the anti-foaming plate 901.

Assembly of the main components described above will be described with reference to FIG. 35, which shows the stationary scroll 1, the orbiting scroll 2, the Oldhams coupling 8, the first frame 6, the second frame 7, the main shaft 4 and the stator 11, etc., in a disassembled state. In FIG. 35, 111 depicts four pairs of pin holes formed in the outer periphery of the stationary scroll 1, the wrap 102 of the stationary scroll 1 being machined by using these pairs of the pin holes 111 as a reference. That is, the pin holes 111 of each pair are arranged oppositely with respect to the center of the wrap 102. 613 depicts four pairs of pin holes formed in the outer periphery of the first frame 6, which are completely symmetrical with respect to the center of the first main bearing 602. In other words, the pin holes 613 of each pair are arranged oppositely with respect to the center of the first main bearing 602. The pitch of the pin holes 613 of the first frame 6 is the same as that of the pin holes 111 of the stationary scroll. 27 depicts pins used for assembling the compressor The assembly of the compressor constituted as above is performed as follows: Firstly, the main shaft 4 is inserted into the second frame 7, and then the socket-and-spigot joint portion 67*a* of the first frame 6 is fitted in the joint portion 76*a* of the second frame 7 using the main shaft 4 as a guide. Thus, the first frame 6 is set so that the first main bearing 602 and the second main bearing 702 are coaxial. Then, the Oldhams coupling 8 is mounted on the first frame 6 so that the pins 702 thereof are slidably fitted in the Oldhams grooves 607 of the first frame 6, and the orbiting scroll 2 is mounted on the first thrust bearing 601 so that the shaft 204 is fitted in the eccentric bushing 5 in the main shaft 4 and the pins 802 of the Oldhams coupling 8 are slidably fitted in the Oldhams grooves 208. Then, by setting the pins 27 so that they fit in the pin holes 111 of the stationary scroll 1 and the pin holes 613 of the first frame 6, the stationary scroll 1 is arranged on the first frame 6 with the center of the wrap 102 thereof being the center of the first main bearing 602. Therefore, by fixing together the stationary scroll 1, the first frame 6 and the second frame 7 by the bolts 106, assembly of the stationary scroll 1, the orbiting scroll 2, the Oldham coupling 8, the first frame 6, the second frame 7 and the main shaft 4, which are main components of the compressor, is complete. The pins 27 may be omitted if desired.

After the stator 11 is mounted on the mounting legs 7*d* of the second frame 7 by the bolts 204 and the rotor 10 is mounted on the main shaft 4 suitably, the outer periphery of the second frame 7 is heat-fitted into the lower shell 9013. Thereafter, by sealing the shell 9013 by the upper shell 902, the assembly of the compressor is complete As mentioned above, with the construction of the first balancer 402, which is integral with the main shaft 4 between the first frame 6 and the second frame 7, it is possible to make the first balancer 402 closer to the orbiting scroll 2, which is the source of unbalancing forces, and thus it is possible to make the balancer compact. This may cause the second balancer 403 to be smaller. The second balancer 403 applies a relatively small radial force to the portion of the main shaft 4 below the second main bearing 702. Therefore, the load to be applied to the second main bearing 702 is small, resulting in an improved reliability of the bearing. Since the boss 7*b* of the frame 7 extends into the counter bore 10*b* of the rotor 10, the load applied to the second main bearing 702 is further reduced.

When the first balancer 402 is mounted on the upper end of the rotor 10 as in the conventional apparatus, it is difficult for the rotor 10 to support the large centrifugal force produced in the first balancer 402 in view of the mechanical strength of the rotor. Such a problem is a eliminated in this embodiment.

The lubricating oil system of this embodiment will be described. The oil subjected to a centrifugal force by the oil pump 12 passes through the oil hole 404 of the main shaft 4 to the bearings. Thereafter, it is discharged radially outwardly of the first thrust bearing 601 through the oil grooves 601*b* thereof. Then, the discharged oil drops onto the grooves 609 of the first frame 6, then onto the upper recesses 705 of the second frame 7 through the oil returning hole 604. Then, after it passes through the oil returning grooves 7*g* on the outer periphery of the mounting legs 7*b* of the second frame 7, it drops onto the anti-foaming plate 910 above the oil reservoir 909*a* through the outer periphery of the stator 11. When the dropping point of the oil from the oil returning hole 604 is set inside of the outer periphery of the first balancer 402, oil discharge is facilitated by the centrifugal force produced by the rotation of the first balancer 402. The oil on the anti-foaming plate 910 passes through the small holes 910*b* to the reservoir 909*a*. The anti-foaming plate 910 functions to prevent oil in the reservoir from being carried away with the coolant mixed in and foamed at the starting of the compressor.

The gas system in the compressor will be described. The gas is introduced through the suction pipe 904 formed in the outer periphery of the lower shell 9013 into the interior of the compressor. Then, it is guided by the partition wall 7*h* of the second frame 7 downwardly to cool the upper portion of the stator 11, and then passes through the gas passages 614*b* to the suction chamber Pi. Thereafter, after being taken into the compression chambers P, it is compressed gradually and discharged through the discharge type 905. Since the gas does not contact with the coil portion of the stator 11 directly, there can be no damage of the coil due to foreign matter mixed in the gas. Further, since the flow rate of the gas is reduced abruptly in a portion below the second frame 7, it is easy to separate oil from the taken in gas and there is little pressure loss of the gas. Further, since little gas flows in and around the lower end of the oil returning groove 7*g*, there is a little possibility of carrying away of the oil by the gas.

In this embodiment, the rotor 10 is offset upwardly with respect to the stator 11. With this arrangement, there is an offset of the magnetic center, resulting in a force acting on the rotor 10 tending to force the latter downwardly. This force may act to prevent the main shaft 4, which tends to be moved upwardly by external forces or vibration generated during the operation of the compressor, from being in contact with the base plate 201 of the orbiting scroll 2.

Each of the Oldhams grooves 607 of the first frame 6 is provided at the outer end portion with an enlarged portion 607*a* so that there is no interference between the pin 802 of the Oldhams coupling 8 and the groove 607 when the pin 802 is moved completely in one side as shown in FIG. 36. When the radius of curvature r of the enlarged portion 607*a* is made equal to one-half of the width W of the groove 607, the same cutter used to machine the groove 607 can be used to cut the enlarged portion 607*a* by shifting the cutter at the outer end of the groove 607 suitably. With the provision of the enlarged portion 607*a* at the outer end of the groove 607, by which interference between the pin 802 of the Oldhams coupling 8 and the groove 607 is prevented, it is possible to provide an economical frame 6 having a small outer diameter. In this figure, 802' depicts the position of the pin 802 when it is moved to an innermost position.

The shell 902 is provided with the sealing terminal 907 for feeding the stator 11, as shown in FIGS. 37A and 37B. A portion of the shell in which the terminal 907 is provided is protruded as shown by 902*b*, while the outer portion is not, so that the height of the shell is not unnecessarily increased. Three phase tabs 9071A, 9071B and 9071C are arranged in the sealing terminal 907, whose directions are common so that three lead wires 9072 can be easily inserted thereinto. 9073 depicts a transparent insulating coating provided on the junctions between the tabs and the lead wires 9072 for preventing interphase short-circuiting. 909 depicts a sealing terminal for control which is connected to the thermostat for detecting the temperature of the motor. Similarly to the sealing terminal 907, the terminal 909 is provided in a protruded portion 902*b* of the shell and tabs 9091A and 909B are arranged in parallel to facilitate insertion of the lead wires 9092 thereinto.

Various embodiments each having unique improvements have been described. It should be noted that these improvements are not limited in each embodiment, but they can be applied to any of the embodiments in various combinations thereof.

As mentioned hereinbefore, the present invention comprises the stationary scroll housed in a shell, an orbiting scroll housed in the shell and, when driven, orbiting to control a volume of fluid in cooperation with the stationary scroll, a first frame housed in the shell, the first frame being adapted to receive a portion of the orbiting scroll, the stationary scroll being fixed to the first frame, a second frame mounted in the shell, a balancer chamber formed between the first and second frames and a main shaft having a balancer housed in the balancer chamber rotatably, the main shaft including the enlarged diameter portion positioned on the side of said orbiting scroll and a small diameter portion positioned opposite the side of the orbiting scroll and extending between the first frame and the second frame for driving the orbiting scroll, a first bearing disposed between the main shaft and the first frame for supporting the main shaft at a position at the side of the orbiting scroll with respect to the balancer, and a second bearing disposed between the main shaft and the second frame for supporting the main shaft at a position opposite to the side of the orbiting scroll with respect to the balancer.

Therefore, with this construction, uneven contact of the main shaft with the bearing due to deformation of the main shaft by a bending moment caused by a centrifugal force produced in the balance are prevented, resulting in an improvement of reliability. Since the first frame need not contact the shell, there is no degradation of the meshing precision of the scrolls during the assembly thereof.

We claim:

1. A scroll-type compression machine comprising:

a shell having an inner and an outer surface;

a motor housed in said shell;

a stationary scroll housed in said shell;

an orbiting scroll housed in said shell and being driveable by said motor in order to control a volume of compressible gas in cooperation with said stationary scroll;

a frame comprising an outer circumferential portion, an upper portion and a lower portion, said outer circumferential portion of said frame being engaged with said inner surface of said shell and said upper portion of said frame supporting said stationary scroll;

a motor mounting leg means forming a part of and projected from said outer circumferential portion of said frame for supporting a motor for driving said orbiting scroll, said motor mounting leg means comprising a plurality of leg-like projections, each having distal end faces and an outer peripheral surface, said projections being formed on said outer circumferential portion of said frame independently of each other;

a gas passage means formed in said motor mounting leg means; and a main shaft having a lower end dipped into an oil pan formed in said bottom portion of said shell, and axial oil feed hole communicating with a bearing portion that connects the main shaft and said orbiting scroll, and a central portion supported at a central portion of said frame, said main shaft driveably connecting said motor and said orbiting scroll to each other;

wherein said motor is fixedly supported to said distal end faces of said leg-like projections and wherein axial grooves are formed in said outer peripheral surfaces of said leg-like projections to form return passages through which lubricant oil is returned from said bearing portion.

2. The scroll fluid machine of claim 1, wherein said frame is engaged with said inner surface of said shell at said outer peripheral surfaces of said motor mounting leg means.

3. The scroll fluid machine of claim 2, wherein an oil returning hole is formed inside of said outer peripheral surface of said balancer.

4. A scroll-type compression machine comprising:

a shell having an inner and an outer surface;

a motor housed in said shell;

a stationary scroll housed in said shell;

an orbiting scroll housed in said shell and having a connecting portion, said scroll, when driven, orbiting to control a volume of compressible fluid in cooperation with said stationary scroll;

a first frame housed in said shell, said first frame having a ring slide surface and having an arcuate groove formed therein, said frame being adapted to receive a portion of said orbiting scroll, said stationary scroll being fixed to said first frame;

a second frame having an outer periphery for attaching said frame to said shell, said first frame being mounted on said second frame;

a balancing chamber formed between said first and second frames and having an outer peripheral surface;

a main shaft having a balancer disposed rotatably in said balancing chamber, said main shaft extending between said first and second frames, said main shaft having a first end dipped into an oil pan formed in said bottom portion of said shell and a second end coupled to said orbiting scroll at the connecting portion thereof, said main shaft having an oil hole opening at said first end and extending to said second end for carrying oil from said oil pan to said second end;

said motor connected to said main shaft for driving said main shaft and, accordingly, said orbiting scroll, said main shaft when driven causing oil to be pumped from said first end to said second end;

an Oldham coupling, having a ring-shape and being located at said second end of said main shaft an said ring slide surface at a position between said orbiting scroll and said first frame, for preventing said orbiting scroll from rotating about its own axis but allowing said orbiting scroll to rotate about an axis of said main shaft, said Oldham coupling receiving oil pumped to said second end and;

a plurality of motor mounting legs projecting downwardly along said outer periphery of said second frame and formed integrally therewith, for supporting said motor;

a gas passage means formed between said motor mounting legs;

a first oil returning hole formed in said arcuate groove formed inside of the ring slide surface of said first frame, said first oil returning hole being in communication with said balancing chamber;

a groove means formed in the axial direction on the outer periphery of said second frame, on the surface of said motor mounting legs; and a second oil returning hole formed in said second frame, said second oil returning hole being in communication with said balancing chamber and said groove means;

wherein after the lubricant oil residing in the oil pan is fed through the main shaft to the connecting portion of said orbiting scroll for lubrication, the oil is returned back to the oil pan through said first and second oil returning holes to form a series hydraulic circuit.

* * * * *